US006983931B2

(12) United States Patent
Kaneko

(10) Patent No.: US 6,983,931 B2
(45) Date of Patent: Jan. 10, 2006

(54) SHEET FOLDING AND BINDING APPARATUS AND METHOD

(75) Inventor: Tamaki Kaneko, Fujisawa (JP)

(73) Assignee: Kaneko Co., Ltd., (JP)

( * ) Notice: Subject to any disclaimer, the term of this patent is extended or adjusted under 35 U.S.C. 154(b) by 0 days.

(21) Appl. No.: 10/849,630

(22) Filed: May 19, 2004

(65) Prior Publication Data

US 2004/0212134 A1 Oct. 28, 2004

Related U.S. Application Data

(62) Division of application No. 09/896,737, filed on Jun. 29, 2001, now Pat. No. 6,755,410.

(30) Foreign Application Priority Data

Jul. 14, 2000 (JP) ..... 2000-213730

(51) Int. Cl.
*B65H 37/04* (2006.01)

(52) U.S. Cl. ..... 270/37; 270/58.09; 270/32; 493/384; 493/445

(58) Field of Classification Search ..... 493/405, 493/416, 436, 384, 444, 445; 270/58.08, 270/58.09, 52.18, 32, 37, 52.17, 58.11, 58.12; 412/18, 19, 9, 20, 33, 35
See application file for complete search history.

(56) References Cited

U.S. PATENT DOCUMENTS 5,267,933 A * 12/1993 Precoma ..... 493/23
5,377,569 A * 1/1995 Richards et al. ..... 83/98
5,377,965 A * 1/1995 Mandel et al. ..... 270/37
5,445,592 A * 8/1995 Richards ..... 493/444
5,746,424 A * 5/1998 Rutten et al. ..... 270/37
5,825,765 A * 10/1998 Menzilcioglu et al. . 370/395.71
5,836,578 A * 11/1998 Hirano et al. ..... 270/58.11
5,905,935 A * 5/1999 Wakamatsu et al. ..... 399/407
5,993,369 A * 11/1999 Sekita et al. ..... 493/420
6,003,853 A * 12/1999 Nakazawa et al. ..... 270/58.11
6,006,065 A * 12/1999 Seki ..... 399/407
6,022,011 A * 2/2000 Hirose ..... 270/37

(Continued)

FOREIGN PATENT DOCUMENTS

JP 61027874 A * 2/1986

(Continued)

*Primary Examiner*—Patrick Mackey
(74) *Attorney, Agent, or Firm*—Cooper & Dunham LLP

(57) ABSTRACT

A binding apparatus includes a receiving device configured to receive a sheet from outside and convey the sheet, and a sheet folding device configured to fold the sheet, conveyed by the receiving device, in two at a center portion thereof in a direction the sheet is conveyed, so as to be a folded sheet, and convey the folded sheet with the folded portion thereof being a leading edge of the folded sheet. A jogging device includes a jogging table and is configured to receive and jog the folded sheet, conveyed by the sheet folding device, one after another, so as to be stacked into a stack of folded sheets on the jogging table. A binding device is configured to bind the stack of folded sheets stacked on the jogging table at an edge portion of the stack of folded sheets at the side where the folded portion of each folded sheet of the stack of folded sheets is located. A discharging device is configured to discharge the bound stack of folded sheets.

13 Claims, 14 Drawing Sheets

U.S. PATENT DOCUMENTS

| | | | | |
|---|---|---|---|---|
| 6,171,225 | B1 * | 1/2001 | Nonoyama et al. | 493/16 |
| 6,224,529 | B1 * | 5/2001 | Honmochi et al. | 493/384 |
| 6,276,677 | B1 * | 8/2001 | Hommochi et al. | 270/32 |
| 6,354,059 | B1 * | 3/2002 | Yoshie et al. | 53/117 |
| 6,561,503 | B1 * | 5/2003 | Ogata et al. | 270/58.12 |

FOREIGN PATENT DOCUMENTS

| | | | |
|---|---|---|---|
| JP | 11011783 | A * | 1/1999 |
| JP | 2001187491 | A * | 7/2001 |
| JP | 2002029175 | A * | 1/2002 |

* cited by examiner

SHEET FOLDING AND BINDING APPARATUS AND METHOD

This is a divisional of application Ser. No. 09/896,737, filed Jun. 29, 2001, now U.S. Pat. No. 6,755,410.

BACKGROUND OF THE INVENTION

1. Field of the Invention

The present invention relates to a binding apparatus, and in particular relates to a binding apparatus that is connected with a sheet discharging part of an image forming apparatus, such as a printer and a copier, and that folds a sheet received from the image forming apparatus and binds stacked folded sheets at the folded side parts of the folded sheets.

2. Discussion of the Background

A binding technology used in producing weekly magazines is well known. After printed sheets are stacked and jogged, the stacked printed sheets are stapled at their center portions by a stapling device. The stapled sheets are then folded at their stapled portions. Because the stapled sheets are folded at their stapled portions, the side edges of the folded sheets, opposite the stapled and folded side of the folded sheets, are not uniform. Therefore, the side edges of the folded sheets, opposite the stapled and folded side, are cut off by a cutting apparatus so as to be uniform.

A binding apparatus is known to be connected with a copying machine, downstream of a sheet discharging part of the copying machine in the sheet discharging direction. The binding apparatus sorts or collates sheets carrying an image on one or both sides of the sheets, which have been discharged from the copying machine, and then jogs and binds the sheets into a stack of sheets.

In the binding technology used in producing a weekly magazine, as described above, the side edges of the folded sheets, opposite the stapled and folded side of the folded sheets, must be cut off by a cutting apparatus so as to be uniform. Noise is produced when the side edges of the folded sheets are cut off by the cutting apparatus. The cutting apparatus is relatively large, heavy and expensive. The life of a knife used in the cutting apparatus is relatively short. Further, the consumption of electric power is relatively large. When the number of printed sheets, which must be folded, is large, the folding apparatus may not sufficiently fold the sheets.

A binding apparatus used in conjunction with a copying machine generally stacks sheets, which have been received from the copying machine, without folding each of the sheets, into a stack of sheets, and then staples the stacked sheets. The stacked sheets are stapled at edge portions of the sheets at one side. Therefore, when a sheet of the stack of stapled sheets is pulled, the stapled part of the pulled sheet is easily torn, so that the pulled sheet is taken apart from the stack of stapled sheets. For avoiding this problem, the stapling position for a stack of sheets must be located well inside of the stack of sheets toward the center portion thereof. This may result in stapling the sheets at a part of the image area of each sheet, so that the inconvenience may be caused such that a part of the image at the stapled part of each sheet cannot be seen. For avoiding the inconvenience, the image must be formed on each sheet with a relatively large margin for stapling, which then reduces the area in each sheet where an image can be formed.

SUMMARY OF THE INVENTION

The present invention has been made in view of the above-discussed and other problems and addresses the above-discussed and other problems.

Preferred embodiments of the present invention provide a novel binding apparatus of a relatively small size, that folds a sheet, and binds stacked folded sheets so that side edges of the bound folded sheets are uniform. The preferred embodiments of the present invention further provide a novel binding apparatus and method that folds a sheet, carrying images of two pages on one side of the sheet and another images of another two pages on the other side of the sheet, at a center portion of the sheet, and that binds folded sheets, which are stacked, at the folded side parts of the folded sheets. The preferred embodiments of the present invention further provide a novel binding apparatus that reliably binds stacked folded sheets without loosening the stack. The preferred embodiments of the present invention further provide a novel binding apparatus that binds folded sheets into a stack of folded sheets so that each of the bound folded sheets is hard to be torn so as not to be easily pulled out of the stack of folded sheets. The preferred embodiments of the present invention further provide a novel binding apparatus and method that binds sheets with a relatively small binding margin so that a relatively large area of each sheet can be used for forming an image thereupon. The preferred embodiments of the present invention further provide a novel sheet folding apparatus that reliably folds a sheet. The preferred embodiments of the present invention further provide a novel jogging apparatus that reliably jog sheets which have been folded at their center portions. The preferred embodiments of the present invention further provide a novel image forming and binding system that allows to form images of image or document data of two pages on one side of a sheet and another images of another two pages on the other side of the sheet, fold the sheet at a center portion thereof, and bind the folded sheets, which are stacked, at the folded side parts of the folded sheets.

According to a preferred embodiment of the present invention, a binding apparatus includes a receiving device configured to receive a sheet from outside and convey the sheet, and a sheet folding device configured to fold the sheet, conveyed by the receiving device, in two at a center portion thereof in a direction the sheet is conveyed, so as to be a folded sheet, and convey the folded sheet with the folded portion thereof being a leading edge of the folded sheet. A jogging device includes a jogging table and is configured to receive and jog the folded sheet, conveyed by the sheet folding device, one after another, so as to be stacked into a stack of folded sheets on the jogging table. A binding device is configured to bind the stack of folded sheets stacked on the jogging table at an edge portion of the stack of folded sheets at the side where the folded portion of each folded sheet of the stack of folded sheets is located. A discharging device is configured to discharge the bound stack of folded sheets.

The binding apparatus may further include a controller to control an operation of the apparatus. The controller receives information on a size of the sheet conveyed from outside. Further, the sheet folding device includes a guiding device configured to guide the sheet conveyed by the receiving device, and a sheet folding/pressing device configured to fold the sheet conveyed by the receiving device and press the folded sheet. The guiding device includes a stopping device configured to stop the sheet being conveyed by the receiving device to be conveyed, and a position the stopping device stops the sheet to be conveyed is set by the controller according to the information on the size of the sheet so that the sheet is folded at the center portion of the sheet by the sheet folding/pressing device. The sheet being conveyed by the receiving device is stopped to be conveyed by the stopping device, so that the center portion of the sheet is downwardly slackened, the slackened centered portion of the sheet is pinched into the sheet folding/pressing device, and thereby the sheet is folded in two at the center portion thereof by the sheet folding/pressing device.

The sheet folding device may further include a detect device configured to detect a leading edge of the sheet guided by the guiding device, a pushing device configured to push the slackened center portion of the sheet toward the sheet folding/pressing device, and a pushing device moving device configured to move the pushing device downwardly toward the sheet folding/pressing device so as to push the slackened center portion of the sheet toward the folding/pressing device and upwardly so as to separate from the sheet folding/pressing device. The pushing device moving device moves the pushing device downwardly to push the slackened center portion of the sheet toward the sheet folding/pressing device at a predetermined timing after detection of the leading edge of the sheet with he detect device, so that the slackened center portion of the sheet is pushed by the pushing device so as to be pinched into and thereby the sheet is folded in two at the center portion thereof by the sheet folding/pressing device.

The pushing device may include a saw-toothed knife to push the center portion of the sheet, so that the sheet is perforated at the pushed center portion of the sheet when the saw-toothed knife pushes the center portion of the sheet.

The sheet folding device may include a sheet folding/pressing device having a pair of sheet folding rollers and a pair of supplementary pressing rollers. The pair of supplementary pressing rollers is arranged downstream of the pair of sheet folding rollers in the direction the folded sheet is conveyed and is angled relative to the pair of sheet folding rollers, and a distance between a nip portion of the pair of supplementary rollers and a nip portion of the pair of the sheet folding rollers at a position corresponding to a widthwise edge of the folded sheet, at a side of a widthwise direction where the pair of the supplementary rollers and the pair of sheet folding rollers are farther separated from each other, is shorter than a length of the folded sheet in the direction the folded sheet is conveyed.

The jogging device may include a leading edge stopping device configured to stop the folded sheet to be conveyed at the leading edge thereof, and a left side jogging device configured to jog the folded sheet with respect to a left side of the folded sheet in a direction the folded sheet is conveyed, a right side jogging device configured to jog the folded sheet with respect to a right side of the folded sheet, and a rear side jogging device configured to jog the folded sheet with respect to a rear side of the folded sheet, each including an upper guide member to guide the folded sheet being conveyed by the sheet folding device toward the jogging table and a jogging member to jog the folded sheets on the jogging table, The upper guide member of each of the left side, right side and rear side jogging devices is configured to swing between a horizontal position where the upper guide member is substantially horizontal so as to hold down a previously conveyed folded sheet on the jogging table and so that the folded sheet being conveyed by the sheet folding device slides over an upper surface of the upper guide member to be stopped by the leading edge stopping device and a slanted position where the upper guide member is upwardly slanted. Each of the left side, right side and rear side jogging devices is configured to move to a first position where the upper guide member thereof in the horizontal position separates from the folded sheet carried on the upper surfaces of the upper guide members of the left side, right side and rear side jogging devices and to a second position where the jogging member thereof is in a position corresponding to a size of the folded sheet being conveyed by the folding device, which is determined by the controller according to the information on the size of the sheet. When the folded sheet is conveyed to the jogging device by the sheet folding device, each of the left side, right side and rear side jogging devices is in the second position and the upper guide member of each of the left side, right side and rear side jogging devices is in the horizontal position.

After the folded sheet has been conveyed by the folding device to the jogging device so as to slide over the upper surfaces of the upper guide members of the left side, right side and rear side jogging devices, each of the left side, right side and rear side jogging devices moves, with the upper guide member thereof kept in the horizontal position, to the first position, where the upper guide member of each of the left, right and rear side jogging devices is swung to the slanted position, and each of the left, right and rear sides jogging devices is then moved to the second position, where the upper guide member of each of the left side, right side and rear side jogging devices is returned to the horizontal position.

The leading edge stopping device may include a leading edge binding position adjusting device configured to change a position the leading edge stopping device stops the folded sheet to be conveyed so that a position in the folded sheet relative to the leading edge thereof where the binding device binds the folded sheet is changed.

The folding device may include a detect device configured to detect that the folded sheet is discharged toward the jogging device, and the jogging device may include a sheet center thrusting device configured to swing between a horizontal position to downwardly thrust the folded sheet carried on the upper surfaces of the upper guide members of the left side, right side and rear side jogging devices and a slanted position where the sheet center thrusting device is upwardly slanted, and a sheet center thrusting device driving device configured to drive the sheet center thrusting device so as to swing between the horizontal position and the slanted position.

The sheet center thrusting device driving device drives the sheet center thrusting device downwardly to move to the horizontal position so as to downwardly thrust the folded sheet carried on the upper surfaces of the upper guide members of the left side, right side and rear side jogging devices, after the detect device detects that the folded sheet has been discharged toward the jogging device, and to swing back to the slanted position, after each of the left side, right side and rear side jogging devices in the second position moves toward outside to the first position, moves again toward inside to the second position after the upper guide member of each of the left side, right side and rear side jogging devices is swung to the slanted position, stops at the second position, and the upper guide member of each of the left side, right side and rear side jogging devices is swung to the horizontal position.

When the binding device binds the stack of folded sheets stacked on the jogging table, the jogging member of each of the left side, right side and rear side jogging devices is in the second position, the upper guide member of each of the left side, right side and rear side jogging devices is in horizontal position, and the sheet center thrusting device is in the horizontal position.

According to another preferred embodiment of the present invention, a sheet folding apparatus includes a pair of sheet folding rollers and a pair of supplementary pressing rollers.

The pair of supplementary pressing rollers is arranged downstream of the pair of sheet folding rollers in a sheet conveyance direction and is angled relative to the pair of sheet folding rollers, and a distance between a nip portion of the pair of supplementary rollers and a nip portion of the pair of the sheet folding rollers at a position corresponding to a widthwise edge of the sheet, at a side of a widthwise direction where the pair of the supplementary rollers and the pair of sheet folding rollers are farther separated from each other, is shorter than a length of the folded sheet in the sheet feeding direction. A portion of a sheet is pinched into the pair of sheet folding rollers so that the sheet is folded in two by the pair of sheet folding rollers, and then the folded sheet is pressed by the pair of supplementary pressing rollers, so that the folded portion of the folded sheet is firmly folded.

According to another preferred embodiment of the present invention, a jogging apparatus includes a jogging table on which a sheet may be stacked one after another, and a leading edge stopping device configured to stop a sheet conveyed from outside at a leading edge thereof, a left side jogging device configured to jog the sheet with respect to a left side of the sheet in a direction the sheet is conveyed, a right side jogging device configured to jog the sheet with respect to a right side of the sheet, and a rear side jogging device configured to jog the sheet with respect to a rear side of the sheet. Each of the left side, right side, and rear side jogging devices includes an upper guide member to guide the sheet conveyed from outside onto the jogging table one after another so as to be stacked into a stack of sheets on the jogging table and a jogging member to jog the stack of sheets on the jogging table. The upper guide member of each of the left side, right side and rear side jogging devices is configured to swing between a horizontal position where the upper guide member is substantially horizontal so as to hold down a previously conveyed sheet on the jogging table and so that the sheet being conveyed from outside slides over an upper surface of the upper guide member to be stopped by the leading edge stopping device and a slanted position where the upper guide member is upwardly slanted. Each of the left side, right side and rear side jogging devices is configured to move to a first position where the upper guide member thereof in the horizontal position separates from the sheet carried on the upper surfaces of the upper guide members of the left side, right side and rear side jogging device and to a second position where the jogging member thereof is in a position corresponding to a size of the sheet being conveyed from outside. When the sheet is conveyed, each of the left side, right side and rear side jogging devices is in the second position and the upper guide member of each of the left side, right side and rear side jogging devices is in the horizontal.

According to another preferred embodiment of the present invention, an image forming and binding system includes an image formation controller configured to generate and transmit image or document data with page and sheet size information and printing and binding instructions thereof, and an image forming apparatus configured to form images of the image or document data received from the image formation controller on both sides of a sheet according to the page and sheet size information and the printing and binding instructions and discharge the sheet, and a binding apparatus configured to bind sheets received from the image forming apparatus. The image forming apparatus forms a second page image and a third page image of images of four pages of the image or document data on a first side of the sheet, which upwardly faces when the sheet is exited from the image forming apparatus, with the second page image at a leading edge side of the sheet in a direction the sheet is conveyed, and a first page image and a fourth page image of the images of four pages on a second side of the sheet, which downwardly faces when the sheet is exited from the image forming apparatus, with the first page image at the leading edge side of the sheet in the direction the sheet is conveyed, and the image formation controller controls the image forming apparatus to form the images of the image or document data starting from last four pages of the image or document data. The binding apparatus includes a controller to control an operation of the binding apparatus. The controller receives the sheet size information and the binding instruction from the image formation controller. A receiving device of the binding apparatus is configured to receive the sheet discharged by the image forming apparatus and convey the sheet. A sheet folding device is configured to fold the sheet, conveyed by the receiving device, in two at a center portion thereof in the direction the sheet is conveyed according to the sheet size information, and convey the folded sheet. A jogging device includes a jogging table and is configured to receive and jog the folded sheet, conveyed by the sheet folding device, one after another, so as to be stacked into a stack of folded sheets on the jogging table according to the sheet size information. A binding device is configured to bind the stack of folded sheets stacked on the jogging table at an edge portion of the stack of folded sheets at the side where the folded portion of each folded sheet of the stack of folded sheets is located according to the binding instruction, and a discharging device configured to discharge the bound stack of folded sheets.

According to another preferred embodiment of the present invention, a method of binding sheets includes receiving a sheet from outside and conveying the sheet; folding the conveyed sheet in two at a center portion thereof in a direction the sheet is conveyed so as to be a folded sheet and conveying the folded sheet with the folded portion of the fold sheet being a leading edge of the folded sheet with a sheet folding device; receiving and jogging the conveyed folded sheet one after another so as to be stacked into a stack of folded sheets with a receiving/jogging device; binding the stack of stacked folded sheets at an edge portion of the stack of folded sheets at the side where the folded portion of each folded sheet of the stack of folded sheets is located with a binding device; and discharging the bound stack of folded sheets.

The binding method may further include receiving information on a size of the sheet, and the folding/conveying may include receiving and guiding the conveyed sheet, setting a position where the conveyed sheet is stopped to be conveyed according to the size of the sheet so that the sheet is folded by the sheet folding device at the center portion of the sheet, and stopping the sheet to be conveyed at the position, so that the center portion of the sheet is downwardly slackened, the slackened center portion of the sheet is pinched into the sheet folding device, and thereby the sheet is folded in two at the center portioned of the sheet by the sheet folding device.

The folding/conveying may further include detecting a leading edge of the sheet, and pushing the slackened center portion of the sheet toward the sheet folding device with a pushing device at a predetermined timing after the detection of the leading edge of the sheet, so that the slackened center portion of the sheet is pinched into the sheet folding device.

In the above-described method, the pushing device may include a saw-toothed knife to push the slackened center portion of the sheet. In this case, the pushing includes perforating the sheet at the pushed center portion of the sheet with the saw-toothed knife.

In the above-described method, the sheet folding device may include a pair of sheet folding rollers and a pair of supplementary pressing rollers. The pair of supplementary pressing rollers is arranged downstream of the pair of sheet folding rollers in the direction the folded sheet is conveyed and is angled relative to the pair of sheet folding rollers, and a distance between a nip portion of the pair of supplementary rollers and a nip portion of the pair of the sheet folding rollers at a position corresponding to a widthwise edge of the folded sheet, at a side of a widthwise direction where the pair of the supplementary rollers and the pair of sheet folding rollers are farther separated from each other, is shorter than a length of the folded sheet in the direction the folded sheet is conveyed. In this case, the folding/pressing includes folding the sheet with the pair of sheet folding rollers and pressing the folded sheet with the pair of supplementary pressing rollers.

The binding method may further include receiving information on a size of the sheet and determining a size of the folded sheet folded at the center of the sheet, and the jogging device may include a leading edge stopping device to stop the folded sheet, an upper guide member to guide the folded sheet conveyed by the sheet folding device and a jogging member to jog the folded sheet. In this case, the receiving/jogging includes, sliding the conveyed folded sheet over an upper surface of the upper guide member of the jogging device, which is in a substantially horizontal position, to be stopped by the leading edge stopping device and to be carried on the upper surface of the upper guide member, moving the jogging device to a first position where the folded sheet carried on the upper surface of the upper guide member separates from the upper guide member to fall onto the jogging table, swinging the upper guide member from the horizontal position to a slanted position where the upper guide member is upwardly slanted, and moving the jogging device to a second position where the jogging member of the jogging device is in a position corresponding to the size of the folded sheet being received.

In the above-described method, the folding device may include a detect device to detect that the folded sheet is discharged toward the jogging device and a sheet center thrusting device to downwardly thrust the folded sheet carried on the upper surface of the upper guide member of the jogging device. In this case, the receiving/jogging further includes detecting that the folded sheet is discharged toward the jogging device with the detect device, and swinging the sheet center thrusting device between a substantially horizontal position where the sheet center thrusting device downwardly thrusts the folded sheet carried on the upper surface of the upper guide member of the jogging device and a slanted position where the sheet center thrusting device is upwardly slanted.

In the above-described method, in the binding, the jogging member of the jogging device is in the second position, the upper guide member is in the horizontal position, and the sheet center thrusting device is in the horizontal position.

The receiving/jogging may further include stopping the folded sheet to be conveyed at a leading edge of the folded sheet so that the folded sheet is jogged relative to the binding device, and adjusting a position to stop the folded sheet so that that a position in the folded sheet relative to the leading edge thereof where the binding device binds the stack of folded sheet is changed.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
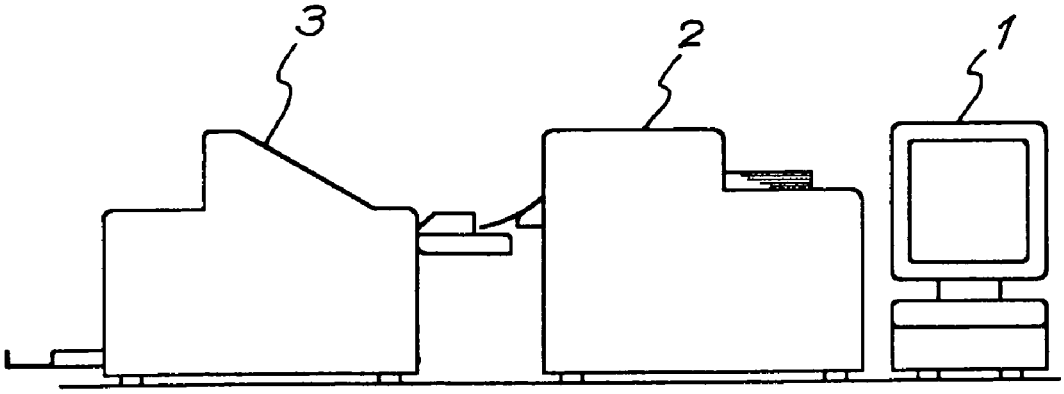
FIG. 1 is a schematic drawing illustrating an image forming and binding system according to a preferred embodiment of the present invention.

Referring now to the drawings, wherein like reference numerals designate identical or corresponding parts throughout the several views, preferred embodiments of the present invention are described.

FIG. 1 is a schematic drawing illustrating an image forming and binding system according to a preferred embodiment of the present invention. Numeral 1 denotes an image formation controller, numeral 2 denotes a printer as an example of an image forming apparatus, and numeral 3 denotes a binding apparatus.

The image formation controller 1 is for example a personal computer including a display, a keyboard, a scanner, etc. The image formation controller 1 generates image or document data by inputting, or reading an image or a document with the scanner, and editing the data. The image formation controller 1 sets the page for the image or document data, sets various printing and binding instructions for printing the data and binding the printed sheets, e.g., the number of printed sets, the size of a sheet for printing, the stapling position, etc. Further, the image formation controller 1 displays a selected operational mode, the status of the system, the printer 2, the binding apparatus 3 etc., with the display.

The image formation controller 1 stores the image or document data, read by the scanner, sent from a separate inputting apparatus or via a network, or generated by the image formation controller 1. The image formation controller 1 edits the stored image or document data, for example, changes the pages of the stored image or document data.

The printer 2 forms an image of the data, sent from the image formation controller 1, on a sheet conveyed from a sheet feeding part of the printer 2. The printer 2 may use such image formation methods as an ink jet system and electrophotography.

The printer 2 reverses the sheet, after formation of an image on one side of the sheet, and then conveys the sheet to the image formation part of the printer 1 for forming another image on the other side of the sheet. The sheet carrying the images on both sides thereof is discharged from the discharging part of the printer 2.

Figure 2:
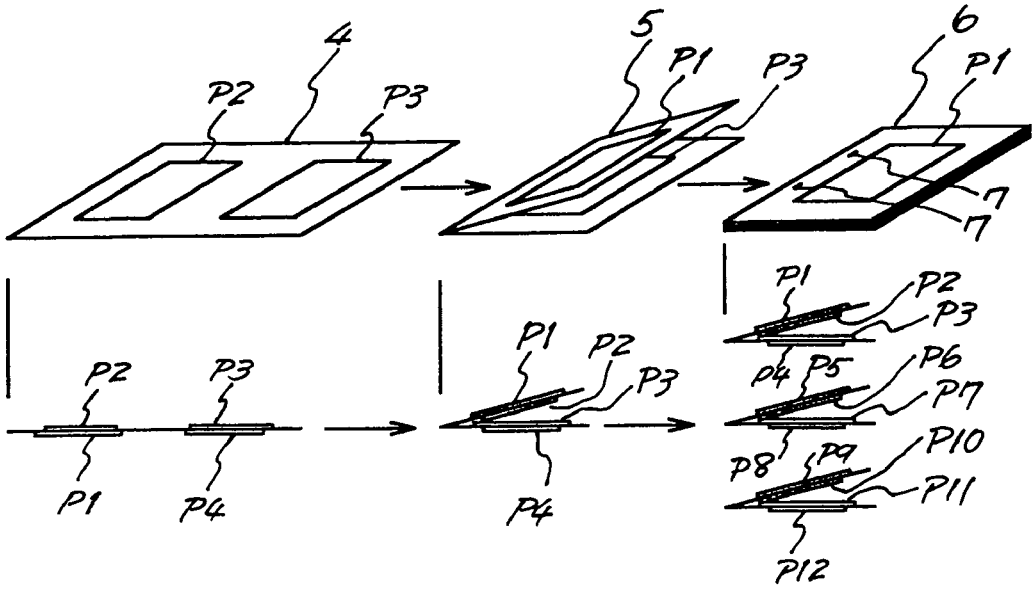
FIG. 2 is a schematic drawing illustrating a state of a sheet.

Referring to FIG. 2 illustrating a state of a sheet, the binding apparatus 3 folds a sheet 4, received from the printer 2, in two at a center portion of the sheet 4 in a direction the sheet 4 is conveyed, so as to be a folded sheet 5. The binding apparatus 3 stacks and jogs the folded sheet 5 into a stack of folded sheets 6, and binds the stack of folded sheets 6 at binding positions 7 near the folded portion of the stack of folded sheets 6.

The image formation controller 1 controls the printer 2 to form images of image or document data such that, when two images for two pages of the data are formed on one side of the sheet 4 and another two images for another two pages of the data are formed on the other side of the sheet 4, as illustrated in the left portion of FIG. 2, a second page image and a third page image of the images of four pages are formed on an upper side of the sheet 4 (i.e., the side of the sheet 4, which upwardly faces when the sheet 4 is exited from the printer 2) with the second page image at a leading edge side of the sheet 4 in the direction the sheet 4 is conveyed, and a first page image and a fourth page image of the images of four pages are formed on a back side of the sheet 4 (i.e., the side of the sheet 4, which downwardly faces when the sheet 4 is exited from the image forming apparatus 2) with the first page image at the leading edge side of the sheet 4 in the direction the sheet 4 is conveyed. Accordingly, when the sheet 4 carrying the four images of four pages on both sides thereof as above is folded by the binding apparatus 3 at the center portion thereof in the direction the sheet 4 is conveyed and is discharged, the images of four pages are in a right order of pages with the first page image on the top surface of the folded sheet 5 and the fourth page image is on the back surface of the folded sheet 5, as illustrated in the center portion of FIG. 2.

The binding apparatus 3 stacks the folded sheet 5 with the first page image of four images of four pages on the top surface of the folded sheet 5 as described. Accordingly, by controlling the printer 2 to print image or document data starting from the last four pages of the data, when the image or document data is printed on a sheet 4 by the printer 2, and the sheet 4 is folded into a folded sheet 5, the fold sheet 5 is stacked one after another into a stack of folded sheets 6 and the stack of folded sheets 6 is bound and discharged by the binding apparatus 3, the images of the data are in right order of pages, i.e., the first page image is on the top surface of the stack of folded sheets 6. For example, when the image or document data is the one of 12 pages, the image formation controller controls the printer 2 to first form the tenth page image and the eleventh page image on the upper surface of a first sheet, and the ninth page image and the twelfth page image on the back surface of the first sheet, and then to form the sixth page image and the seventh page image on the upper surface of a second sheet and the fifth page image and the eighth page on the back surface of the second sheet, and so on. A computer program for the image formation controller to control the printer 2 as described above can be practiced by an ordinary skilled programmer.

Figure 3:
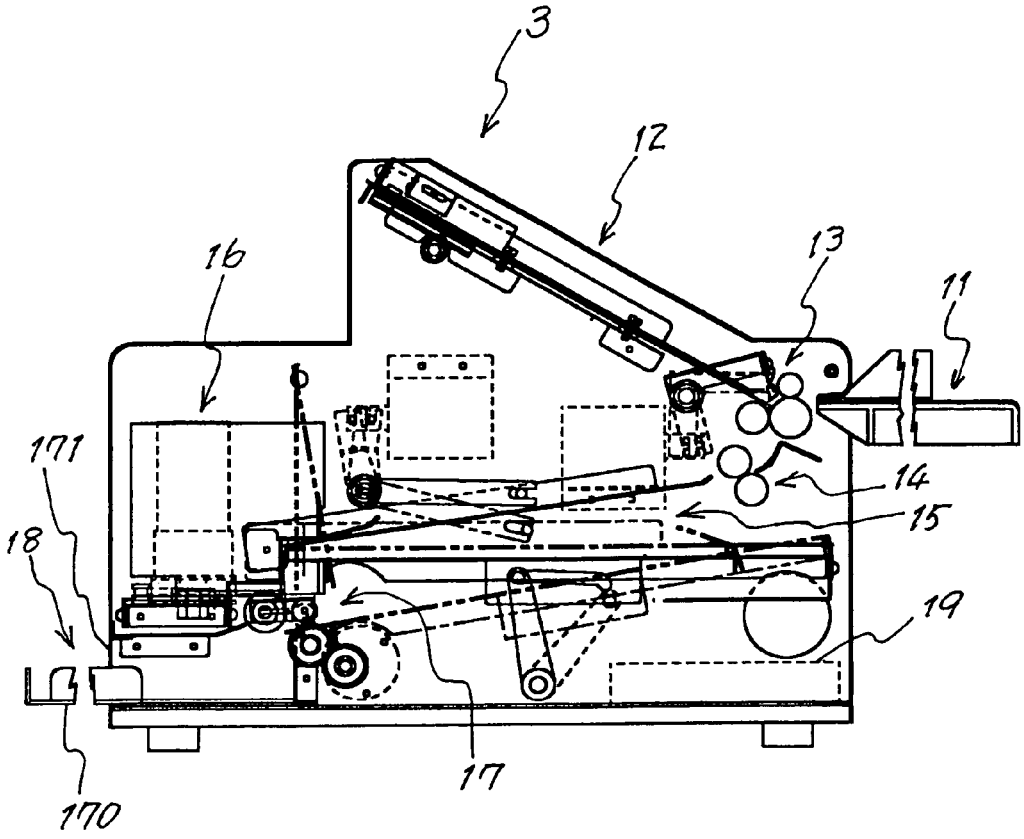
FIG. 3 is a cross section of a binding apparatus according to a preferred embodiment of the present invention.

The binding apparatus 3 includes, as illustrated in FIG. 3, a sheet receiving part 11, a sheet guiding part 12, a sheet folding part 13, a supplemental pressing part 14, a jogging part 15, a binding part 16, a stack discharging part 17, an exit part 18, and a controller 19. The sheet guiding part 12, the sheet folding part 13, and the supplementary pressing part 14 constitute a sheet folding device of the present invention.

Figure 4:
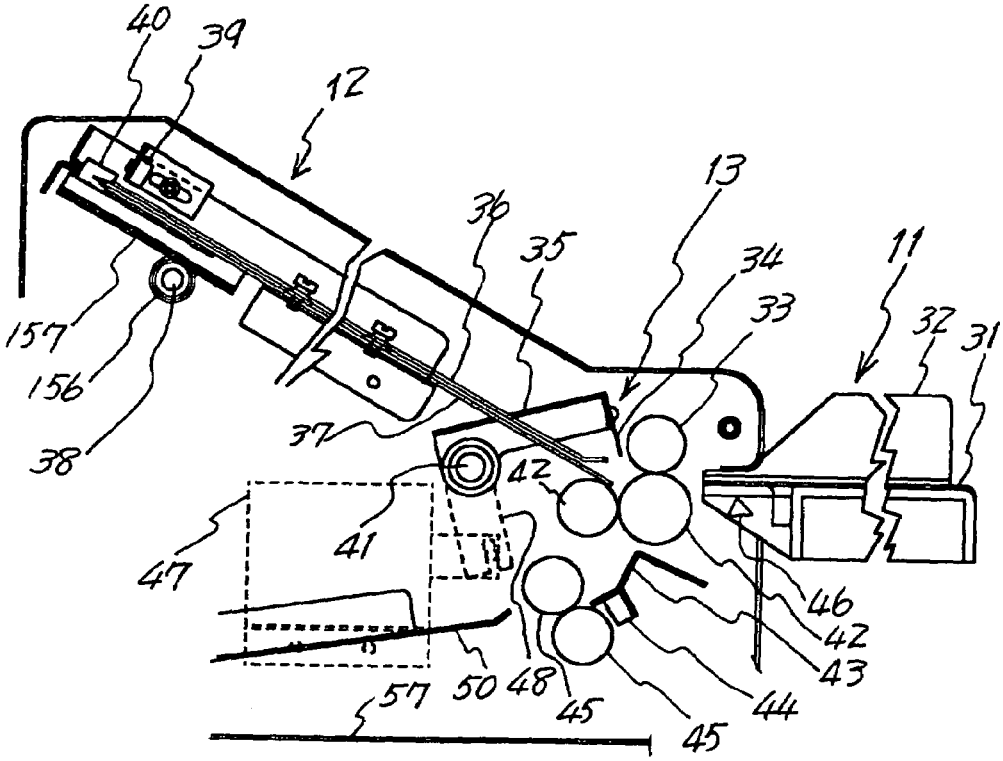
FIG. 4 is a cross section illustrating a sheet receiving device, a sheet guiding part, a sheet folding part, and a supplementary pressing part of the binding apparatus.
Figure 5:
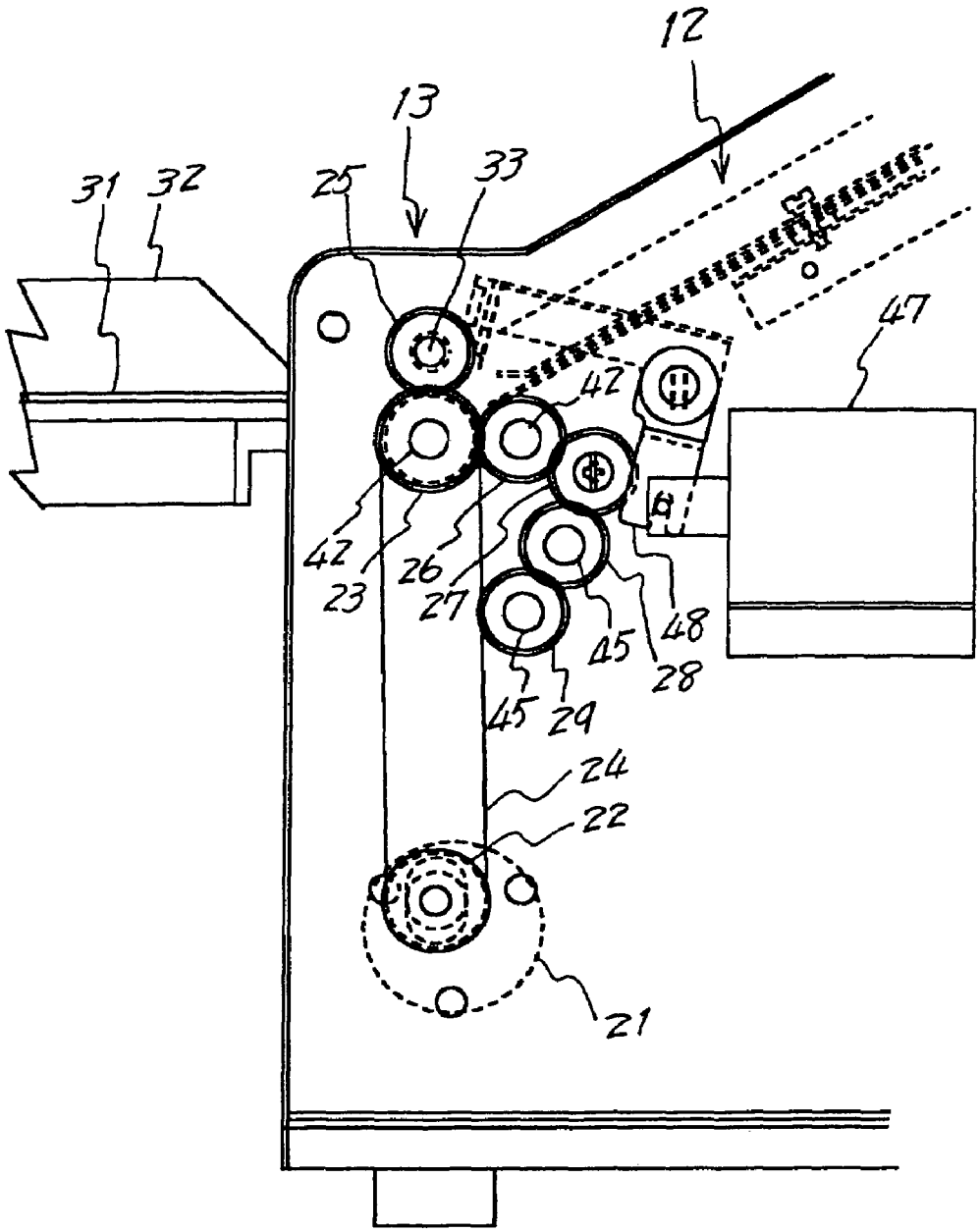
FIG. 5 is cross section illustrating a driving mechanism of the sheet folding part, the supplementary pressing part and a knife unit of the sheet folding part of the binding apparatus.

The sheet receiving part 11 includes, as illustrated in FIG. 4, a sheet receiving table 31, a side guide pair 32, a sheet sensor 46, an entrance roller 33, and a driving mechanism including an entrance motor 21 illustrated in FIG. 5, which is a view of a part of the binding apparatus 3, where the sheet receiving part 11 is provided, from the rear side thereof. The sheet receiving table 31 is fixed to the main body of the binding apparatus 3. The side guide pair 32 is provided to the sheet receiving table 31 so as to guide the sheet 4, conveyed from the printer 2, with respect to right and left side positions of the sheet 4 in the sheet feeding direction. The sheet sensor 46 detects conveyance of the sheet 4, jamming of the sheet 4 at the sheet receiving part 11, and counts the number of the sheets 4 received by the sheet receiving part 11. The entrance roller 33 is arranged above a sheet folding roller pair 42 of the sheet folding part 13 (described later) with a predetermined pressure given thereto.

As illustrated in FIG. 5, the entrance roller 33 includes a gear 25, which is provided on the same axis as that of the entrance roller 33 and outside of a side plate of the binding apparatus 3. The gear 25 engages with a pulley 23, fixed to the sheet folding roller pair 42 of the sheet folding part 13 (described later), so that the entrance roller 33 rotates at the same circumferential speed as that of the sheet folding roller pair 42. The pulley 23 engages with a gear 26, and via an idle gear 27, engages with a gear 28 and a gear 29, to which a supplementary pressing roller pair 45 of the supplementary pressing part 14 (described later) are fixed.

A pulley 22 fixed to the entrance motor 21 and the pulley 23 are connected with each other via a belt 24. When the entrance motor 21 starts to rotate upon detection of the sheet 4 with the sheet sensor 46, the entrance roller 33, the sheet folding roller pair 42, and the supplementary pressing roller pair 45 start to rotate at the same time.

Thus, the entrance roller 33 and the sheet folding roller pair 42 rotate at the same circumferential speed to convey the sheet 4, conveyed from outside, to the sheet guiding part 12.

Referring back to FIG. 4, the sheet guiding part 12 includes, an upper guide plate 36, a lower guide plate 37, a sheet stopper 40, and a sheet leading edge sensor 39.

The upper guide plate 36 and the lower guide plate 37 may be substantially on a plane extending from the upper surface of the sheet receiving table 31. However, as illustrated in FIG. 4, the upper guide plate 36 and the lower guide plate 37 may be upwardly angled relative to the upper surface of the sheet receiving table 31 so that the sheet 4 can be easily folded. In the embodiment, the upper guide plate 36 and the lower guide plate 37 are angled about 30°, but can be angled up to about 45°.

Further, the upper guide plate 36 and the lower guide plate 37 are spaced from each other so that the sheet 4 conveyed by the entrance roller 33 slides into between the upper guide plate 36 and the lower guide plate 37. A window is provided in the upper guide plate 36 and the lower guide plate 37, and a sheet stopper 40 is arranged so as to slidably engage with the window to stop the sheet 4 from sliding between the upper guide plate 36 and the lower guide plate 37. The sheet leading edge sensor 39 is arranged in front of the sheet stopper 40 in the sheet conveying direction.

An adjusting rack 157 is fixed to the sheet stopper 40. An adjusting pinion 156, fixed to an adjusting axis 38, engages with the adjusting rack 157. With rotation of the adjusting axis 38, the adjusting rack 157 moves, so that the sheet stopper 40 slidably moves along the window of the upper guide plate 36 and the lower guide plate 37.

Figure 6:
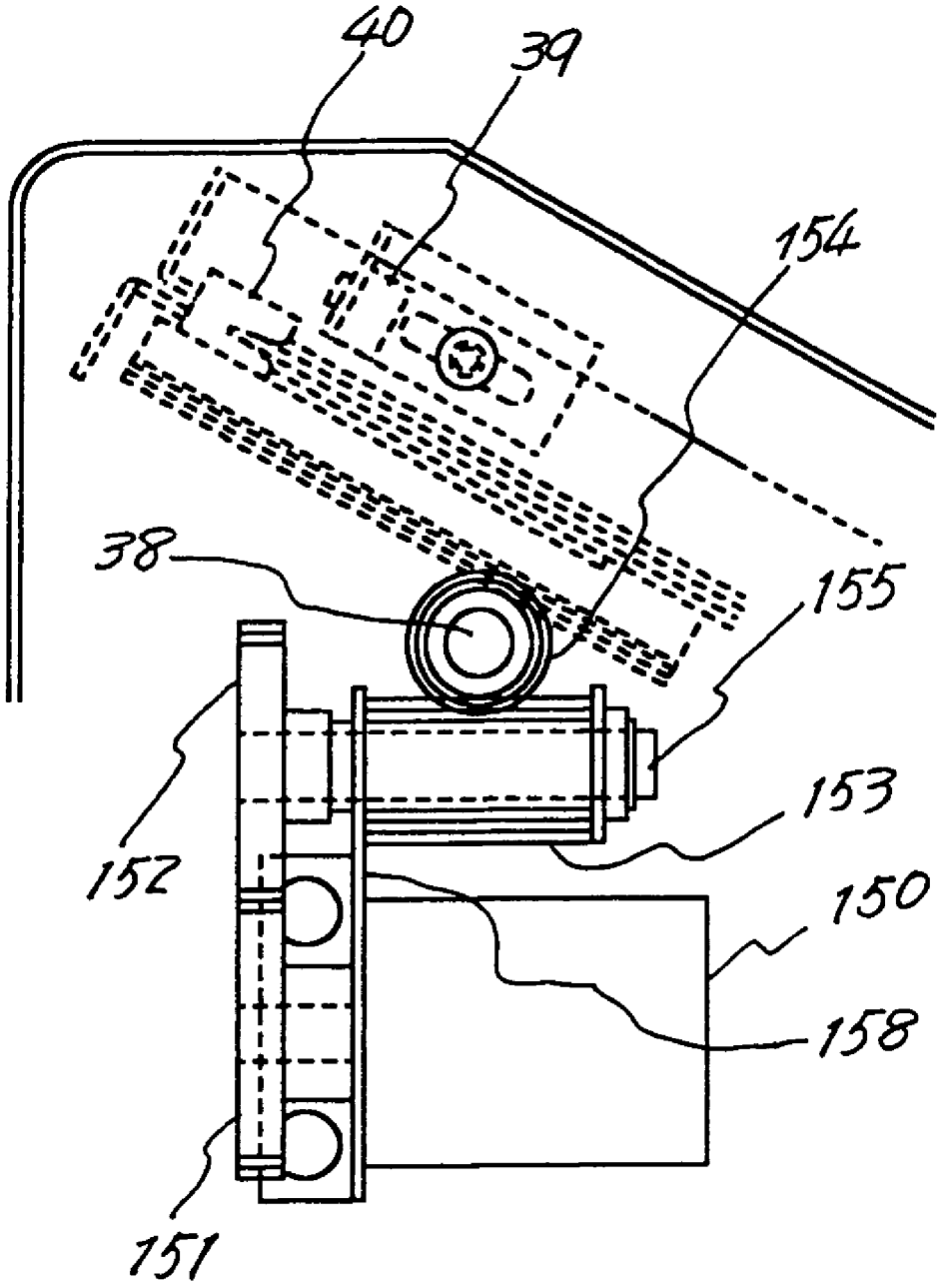
FIG. 6 is a cross section illustrating a sheet stopping position adjusting mechanism of the binding apparatus.

As illustrated in FIG. 6, the adjusting axis 38 is rotatably mounted to the both side plates of the main body of the binding apparatus 3. An adjusting worm gear 154 is fixed to the outside surface of the side plate of the main body and engages with an adjusting worm 153.

The adjusting worm 153 is fixed to the adjusting axis 155, and is rotatably supported by a motor mounting plate table 158 via a bearing. An adjusting gear 152 is fixed at one end of the adjusting gear 155, and the adjusting gear 152 engages with an adjusting gear 151 fixed to an axis of an adjusting motor 150, which is fixed to the motor mounting table 158. With rotation of the adjusting motor 150, the adjusting axis 38 rotates, so that the sheet stopper 40 moves.

Referring back to FIG. 4 again, when the sheet 4 (not shown), which has slid into between the upper guide plate 36 and the lower guide plate 37, is stopped by the sheet stopper 40, the sheet 4 slackens downwardly toward the sheet folding roller pair 42 at a portion thereof, which is out of the upper guide plate 36 and the lower guide plate 37. The slackened portion of the sheet 4 is pinched into the sheet folding roller pair 42, so that the sheet 4 is folded by the sheet folding roller pair 42.

The position of the sheet stopper 40 is determined by the controller 19 according to the information as to the size of the sheet 4, sent from the image formation controller 1, so that the sheet 4 slackens at the center portion thereof, and the slackened center portion is pinched into the sheet folding roller pair 42. Thereby, the sheet 4 is folded at the center portion thereof.

The sheet folding part 13 includes, as illustrated in FIG. 5, the sheet folding roller pair 42, which is driven by the entrance motor 21. The sheet folding roller pair 42 rotates at the same time when the supplementary pressing roller pair 45 rotates, and rotates at the same circumferential speed as the supplementary pressing roller pair 45, as described above.

The sheet folding part 13 further includes, as illustrated in FIG. 4, a knife unit 35 in which a knife 34 is integrally mounted. The knife unit 35 is mounted to an axis 41, which is rotatable relative to the side plate of the main body of the binding apparatus 3. The sheet folding part 13 further includes a solenoid 47, which is mounted to the outside surface of the side plate of the main body, and an arm 48, which is connected with the solenoid 47 and which rotates the axis 41 on which the knife unit 35 is mounted by operation of the solenoid 47. The solenoid 47 and the arm 48 constitute a knife unit upwardly/downwardly moving device.

When operating the knife unit 35, after the sheet leading edge sensor 39 detects a leading edge of the sheet 4, at a predetermined timing the solenoid 47 operates so as rotate the knife unit 35 around the axis 41 in the clockwise direction. Thereby, the sheet 4 is pushed by the knife unit 35 at the slackened center portion thereof toward the sheet folding roller pair 42, so that the pushed slackened center portion of the sheet 4 is pinched into the sheet folding roller pair 42.

The edge of the knife 34 is formed, for example in a saw-toothed shape. When the knife 34 is saw-toothed, the sheet 4 is perforated at the pushed portion of the sheet 4, so that the sheet 4 is easily folded at the perforated portion of the sheet 4.

Once the slackened and pushed center portion of the sheet 4 is pinched into the sheet folding roller pair 42, the solenoid 47 is turned off, and at the same time the knife unit 35 is released to return to the position illustrated in FIG. 4.

The sheet 4 may be folded at the center portion thereof, without using the knife unit 35 having the knife 34. However, by use of the above-described knife unit 35, the sheet 4 can be more reliably folded at the center portion thereof with the sheet folding roller pair 42.

Figure 7:
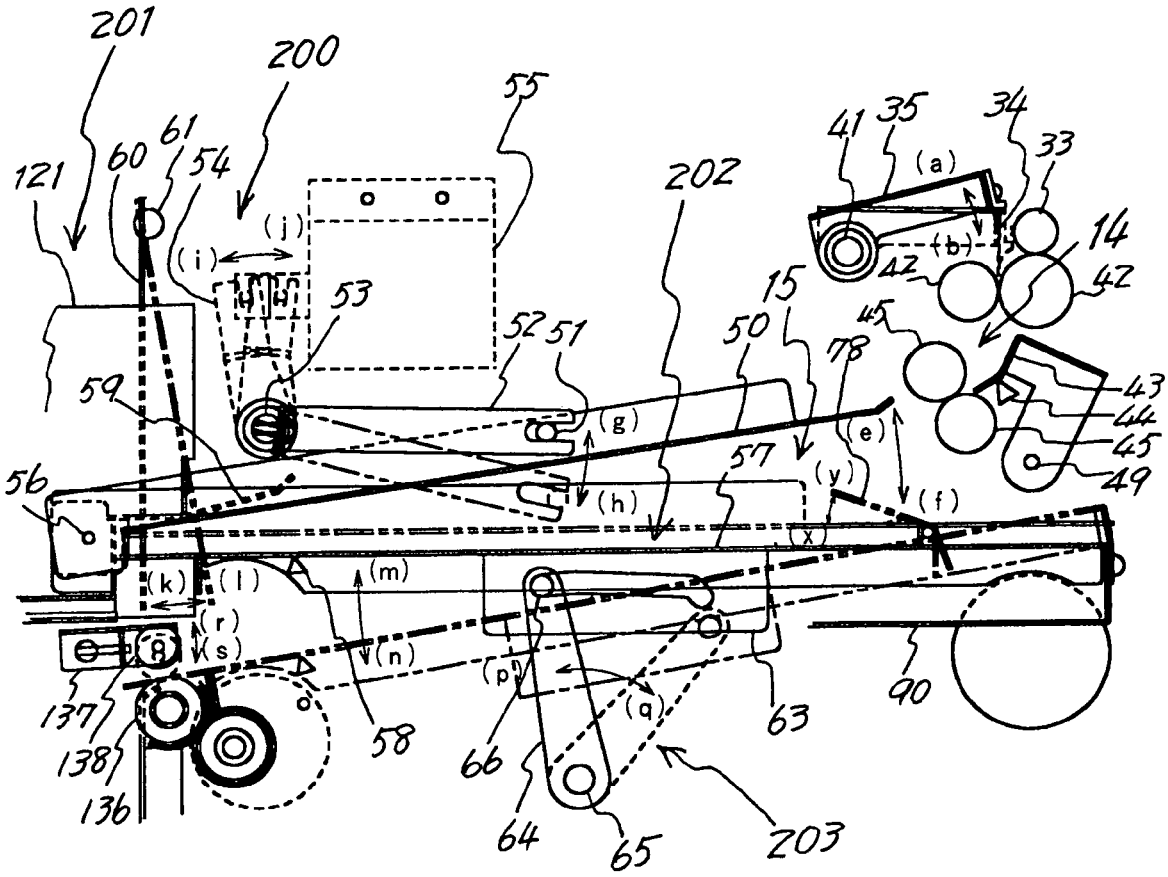
FIG. 7 is cross section illustrating a mechanism of a jogging part of the binding apparatus.

The supplementary pressing part 14 includes, as illustrated in FIG. 7, the supplementary pressing roller pair 45, an intermediate guide plate 43, a sheet sensor 44, and a supporting axis 49 around which the intermediate guide plate 43 rotates in the clockwise direction. The intermediate guide plate 43 can be rotated around the axis 49 in the clockwise direction when removing a sheet jammed in the supplementary pressing part 14. The supplementary pressing roller pair 45 presses the folded portion of a folded sheet 5, which has been conveyed by the sheet holding roller pair 42 with the folded portion of the folded sheet 5 as the leading edge, so as to be further firmly folded, and conveys the folded sheet 5 to a subsequent process.

Figure 8:
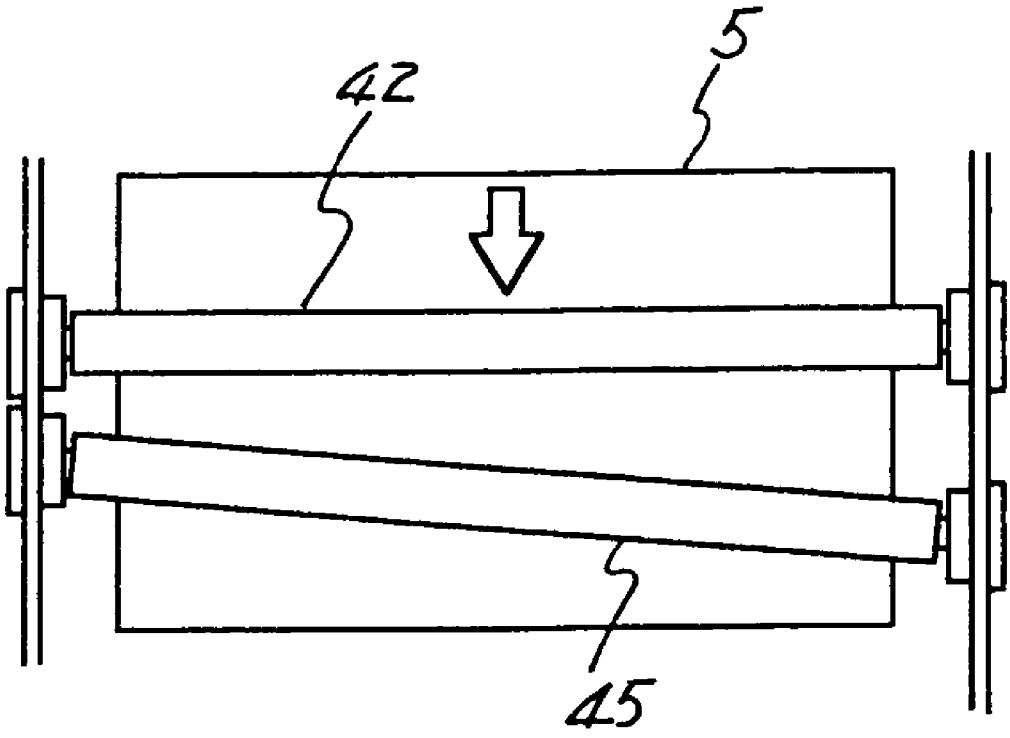
FIG. 8 is a schematic drawing for explaining a positional relationship of a sheet folding roller pair of the sheet folding part and a supplementary pressing roller pair of the supplementary pressing part.

The supplementary pressing roller pair 45 is arranged so as to be angled relative to the sheet folding roller pair 42, as illustrated in FIG. 8. By arranging the supplementary pressing roller pair 45 so as not to be in parallel to the sheet folding roller pair 42, the folded portion of the folded sheet 5 is successively pressed by the supplementary pressing roller pair 45 at a portiori of the folded portion, starting with the portion thereof at one side of the folded sheet 5 to the other portion thereof at the other side of the folded sheet 5. Because the folding portion of the folded sheet 5 is protuberant relative to the other portions of the folded sheet 5, when the folded sheet 5 passes through the supplementary roller pair 45, the folded portion of the folded sheet 5 receives pressure higher than the one given to the other portions of the folded sheet 5 by the supplementary pressing roller pair 45, thereby the folded portion of the folded sheet 5 is effectively pressed by the supplementary pressing roller pair 45. Thereby, the sheet 4 is reliably folded. In this case, when the pressure between the supplementary pressing roller pair 45 is constant, as the angle of the supplementary pressing roller pair 45 relative to the sheet folding roller pair 42 increases, the pressure given to the folding portion of the folded sheet 5 increases, so that the sheet 4 is more reliably folded.

For conveying a folded sheet 5 without curving the conveying direction while applying a pressure to the folded portion of the folded sheet 5 by the supplementary pressing roller pair 45, the supplementary pressing roller pair 45 must complete applying of the pressure to the folded portion of the folded sheet 5, before the rear end of the folded sheet 5 passes through the sheet folding roller pair 42, i.e., while the sheet folding roller pair 42 is pinching the folded sheet 5. Once the supplemental pressing roller pair 45 completes applying the pressure to the folded portion of the folded sheet 5, then the force of the supplementary pressing roller 45 to curve the conveyance direction of the folded sheet 5 decreases, because the pressure being applied to the folded sheet 5 by the supplementary roller pair 45 is uniform in the widthwise direction of the folded sheet 5, so that the folded sheet 5 is correctly discharged toward a jogging table 57 (FIG. 7).

Practically, the supplementary pressing roller pair 45 can be arranged so as to be angled relative to the sheet folding roller pair 42 between about 1° and about 20°. If the supplementary pressing roller pair 45 is excessively angled relative to the sheet folding roller pair 42, e.g., more than about 20°, supporting of the supplementary pressing roller pair 45 at the side plate of the main body of the apparatus is hard.

When the distance between a nip portion of the sheet folding roller pair 42 and a nip portion of the supplementary pressing roller pair 45 at a position corresponding to a widthwise edge of the sheet 5 at a side, in the widthwise direction, where the supplementary pressing roller 45 and the sheet folding roller pair 42 are farther separated from each other, is shorter than the length of the folded sheet 5 in the sheet conveying direction, then pressing of the folded portion of the sheet 4 with the supplementary pressing roller pair 45 is completed while the sheet folding roller pair 42 is pinching the folded sheet 5, so that the folded sheet 5 is correctly discharged.

Referring back to FIG. 7, the jogging part 15 includes, as illustrated in figure, a sheet center thrusting mechanism 200, which thrusts a folded sheet 5 on the jogging table 7 from above, a stapling position determining mechanism 201 which makes uniform the leading edges the folded sheets 5 on the jogging table 57, i.e., the folded portions of the folded sheets 5, a jogging table part 202, and a jogging table upward/downward moving mechanism 203.

The sheet center thrusting mechanism 200 includes, as illustrated in FIG. 7, a sheet center thrusting plate 50, an axis 56 for the sheet center thrusting plate 50 to swing, an upper guide 59 which guides, from above, both sides of the leading edge of the folded sheet 5, an axis 51 which is integrally mounted to the sheet center thrusting plate 50, an arm 52 which transmits a swinging force to swing the sheet center thrusting plate 50 to the sheet center thrusting plate 50, an axis 53 which is rotatably mounted to the side plate of the main body and around which the arm 52 rotates, a solenoid 55 which performs the swinging operation of the sheet center thrusting plate 50, and an arm 54 which transmits a force of the solenoid 55 to the arm 52 as a rotation movement. The arm 52, the axis 53, and the arm 54 are integrated with each other.

Figure 9:
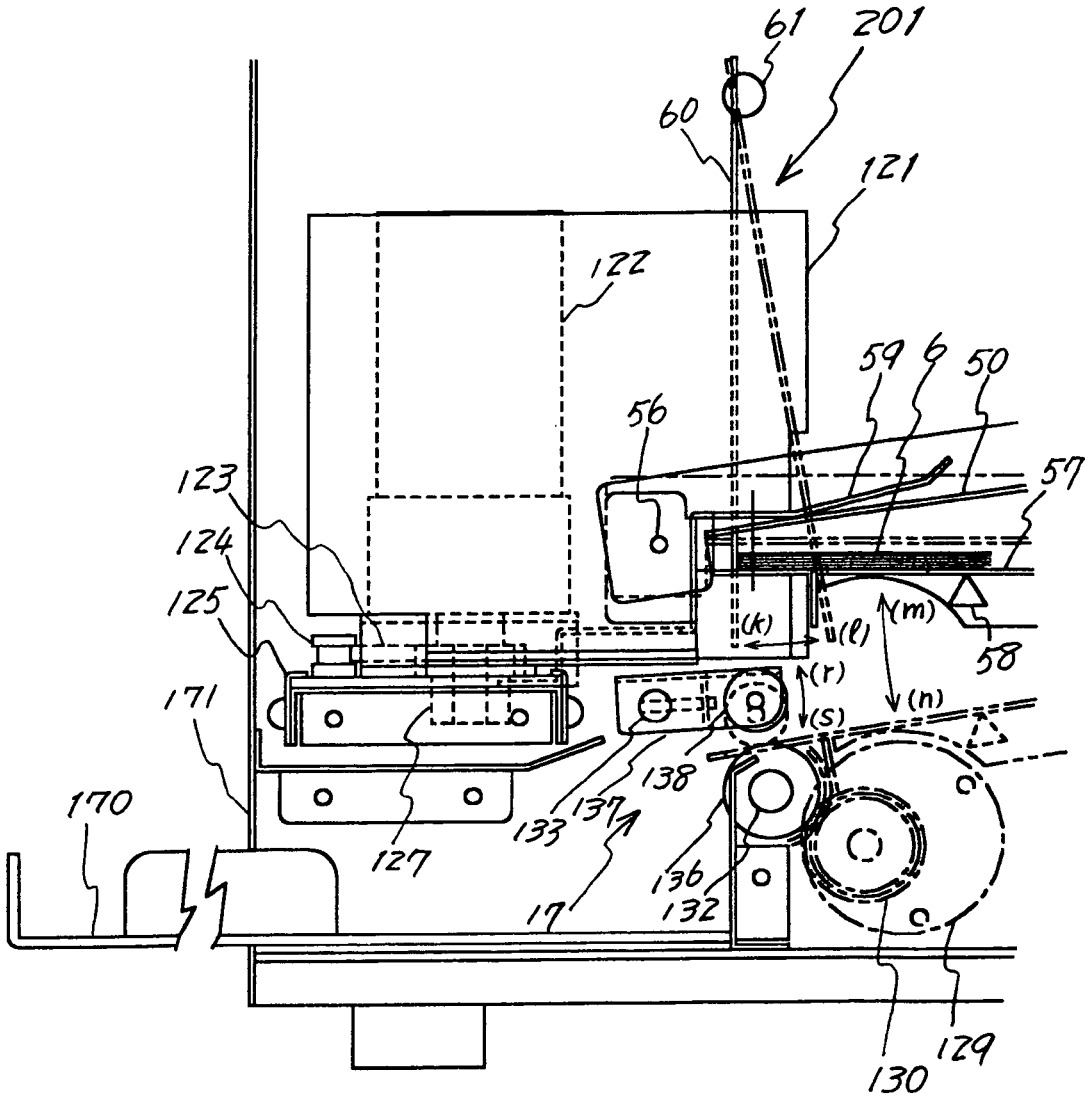
FIG. 9 is cross section illustrating mechanisms of a binding part and a stack discharging part of the binding apparatus.
Figure 10:
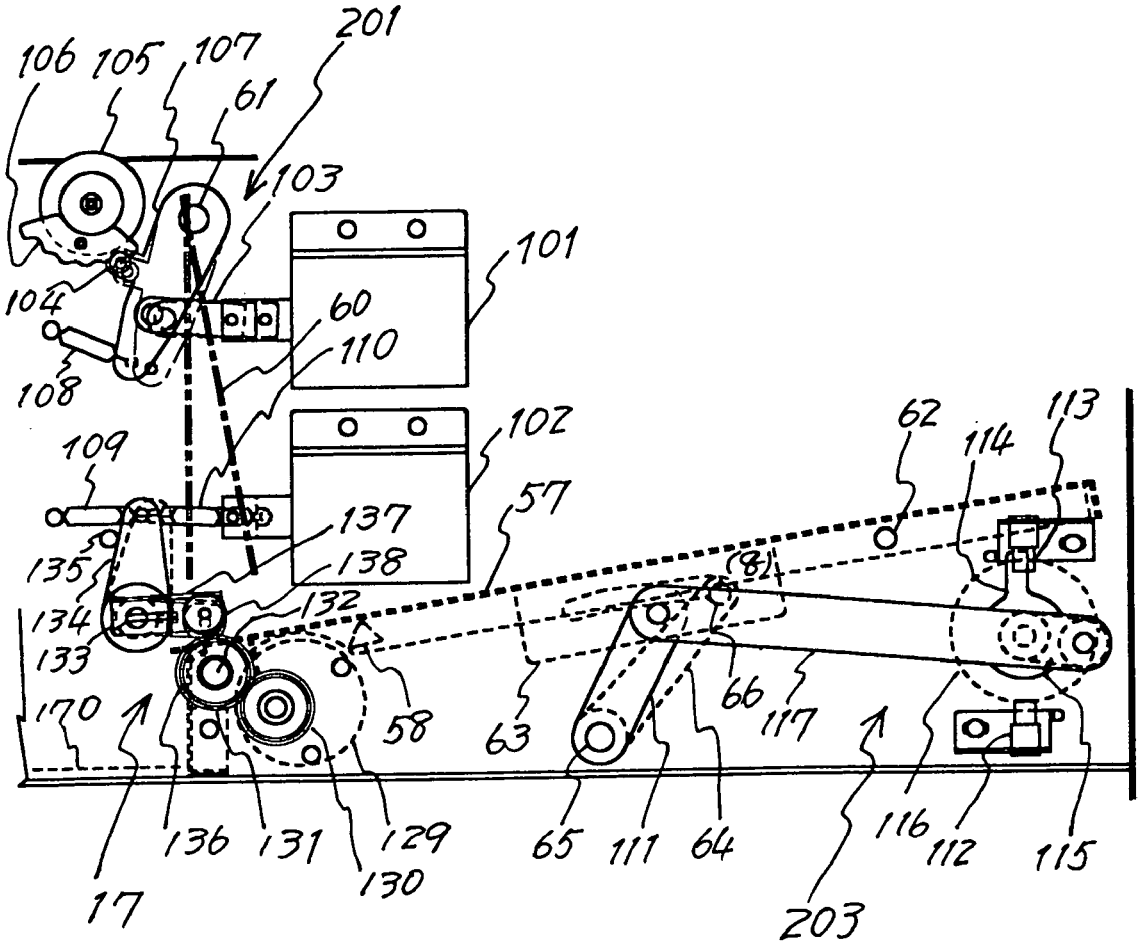
FIG. 10 is a cross section for explaining the operations of a stapling position determining mechanism, a jogging table upwardly/downwardly moving mechanism and a sheet stack discharging part driving mechanism of the binding apparatus.

Referring now to FIG. 9 and FIG. 10, the stapling position determining mechanism 201 determines the position where a position determining plate 60 stops in order to determine the position for the stapler 121 to staple the stack of folded sheets 6 with respect to the leading edge of the stack of folded sheets 5. Further, the stapling position determining mechanism 201 pushes back the stapled stack of folded sheets 6 from the position where the stack of folded sheets 6 has been stapled.

In FIG. 10, the position determining plate 60 stops a folded sheet 5 (not shown) being conveyed over the jogging table 57 at a leading edge of the folded sheet 5. An axis 61, to which the position determining plate 60 is fixed, is rotatably mounted to the side plate of the main body, and an arm 107 is fixed to the outside surface of the side plate of the main body. A spring 108 is mounted to the tip end of the arm 107. The spring 108 always pulls the arm 107 in the clockwise direction, so that a roller 104, mounted to the arm 107, is pressed against a cam plate 106, which is fixed to a stapling position adjusting knob 105. The stapling position adjusting knob 105 is mounted to the side plate of the main body, and the operation thereof is regulated by a spring (not shown) so as to be rotatable only by a manual operation thereof. By manipulating the stapling position adjusting knob 105, the stapling position relative to the leading edge of a stack of folded sheets 6 can be adjusted.

The cam plate 106 fixed to the stapling position adjusting knob 105 engages with the roller 104 of the arm 107. The position of the position determining plate 60 is adjusted according to the position of the stapling position adjusting knob 105 to stop rotating.

The arm 107 rotatably supports a link 103 at one end of the link 103, and the other end of the link 103 is connected with a solenoid 101. With the operation of the solenoid 101, the arm 107 connected with the link 103 rotates in the counterclockwise direction. Thereby, the position determining plate 60 fixed to an axis 61 of the arm 107 swings in the counterclockwise direction, so that, in FIG. 9, the stack of folded sheets 6 on the jogging table 57, which has been stapled, is pushed back toward right in FIG. 9.

Figure 11:
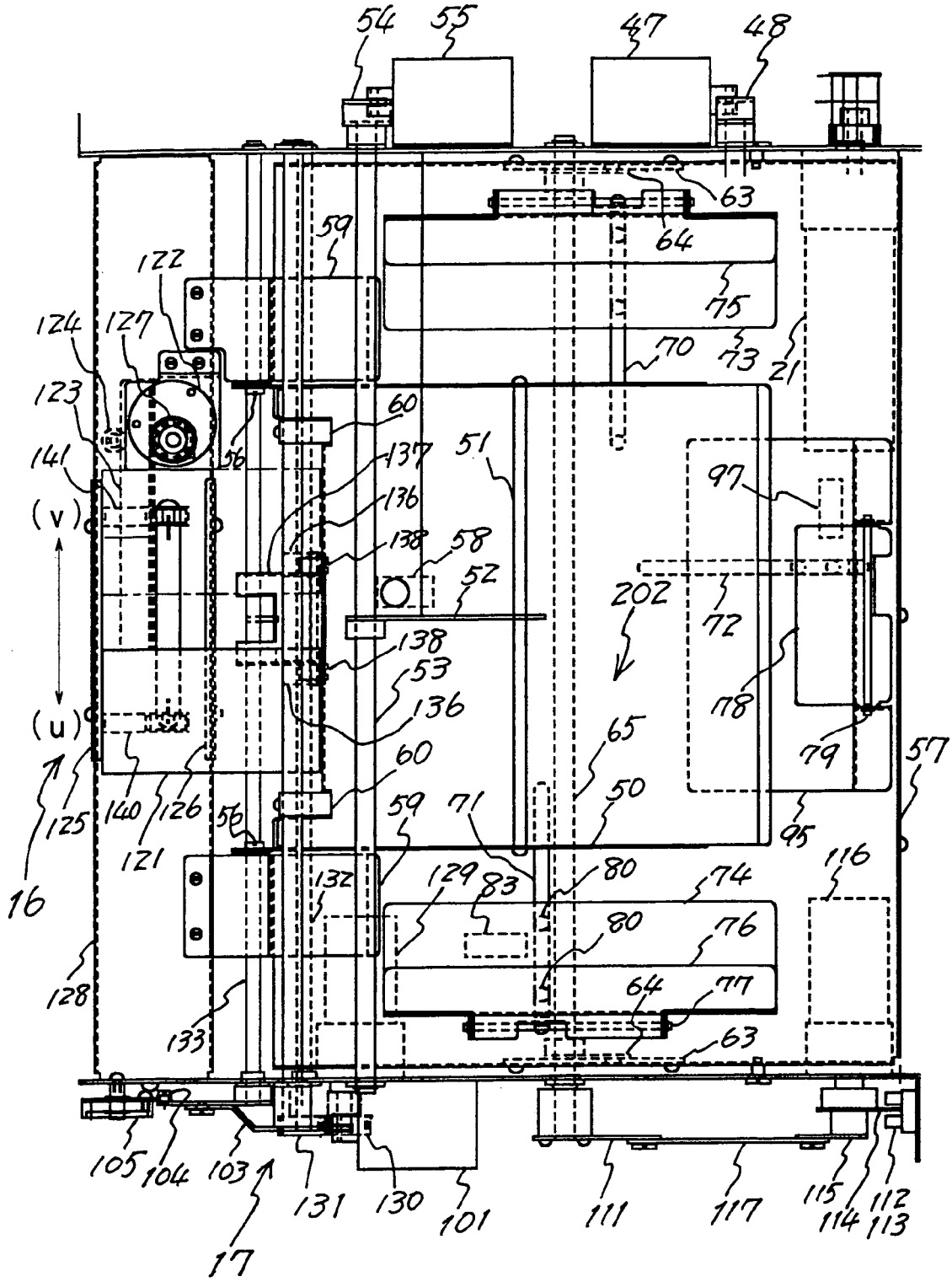
FIG. 11 is a plan view of a jogging table part of the binding apparatus.
Figure 12:
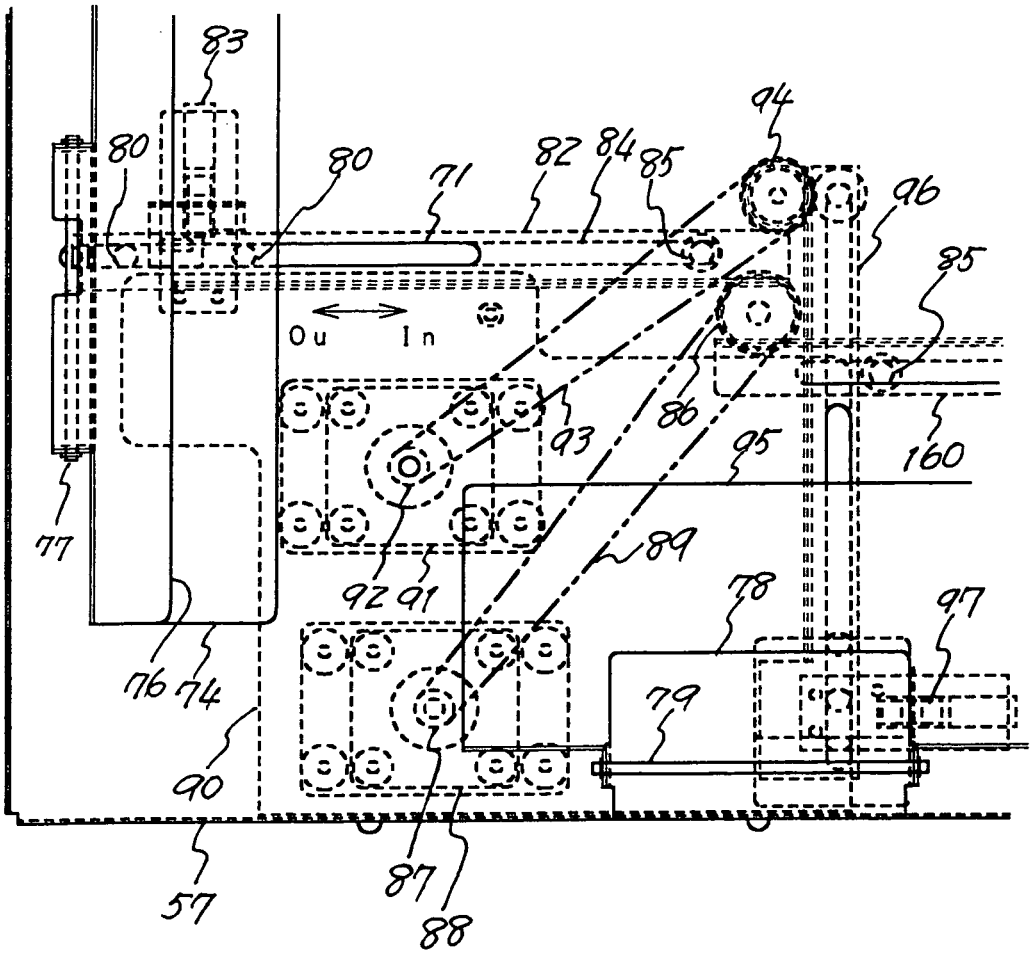
FIG. 12 is a plan view of a part of the jogging table part for explaining an operation of jogging a sheet.

The jogging table part 202 includes, as illustrated in FIG. 7, a sensor 58, which is mounted to the jogging table 57 to detect existence of a sheet on the jogging table 57. The jogging table part 202 further includes, as illustrated in FIG. 11 and FIG. 12, a left side jogging plate 74, which jogs the sheet at the left side of the sheet in the sheet advancing direction, and a left side upper guide 76, which guides the sheet at the left side of the sheet and which is attached to the left side jogging late 74. A jogging plate pin 80, integrated with the left side jogging plate 74, slides in a left side jogging plate guiding groove 71 of the jogging table 57, so that the left side jogging plate 74 and the left side upper guide 76 move over the jogging table 57. The left side upper guide 76 is supported by the left side jogging plate 74 via a jogging plate axis 77 so as to swing around the jogging plate axis 77.

Further, referring to FIG. 12, FIG. 13 and FIG. 14, a lower plate 99 of the left side upper guide 76, which is downwardly bent (FIG. 13), extends, through the left side jogging plate guiding groove 71 of the jogging table 57 (FIG. 12), to a hole 119 of a left side jogging plate rack 82 (FIG. 14) (described later).

The jogging plate part 202 further includes, as illustrated in FIG. 12, the left side jogging plate rack 82 and a right side jogging plate rack 160. Referring also to FIG. 13, a motor 88 is mounted to a back plate 90 of the jogging table 57. A pulley 87 directly connected with the motor 88 and a pulley 86 connected with the pulley 87 via a belt 89 are rotated by the motor 88, and thereby, the jogging plate rack 82 and the right side jogging plate rack 160 are rotated by a pinion integrated with the pulley 86.

Figure 13:
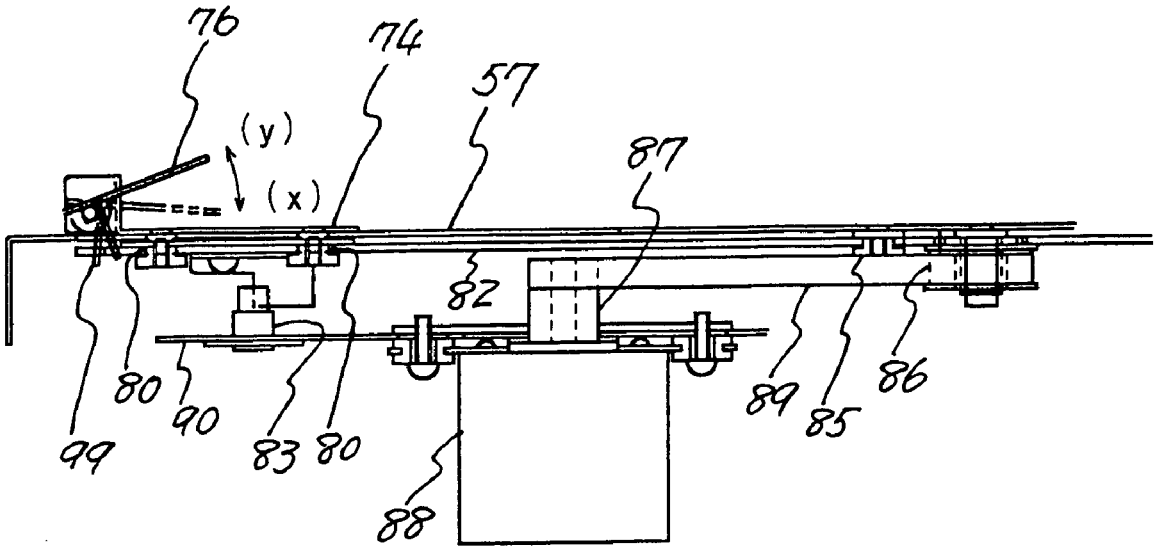
FIG. 13 is a cross section of the part of the jogging table part of FIG. 10 for explaining the operation of jogging a sheet.
Figure 14:
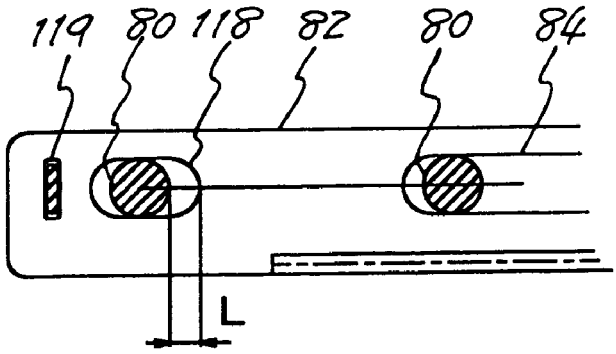
FIG. 14 is a schematic drawing of a part of the jogging table part for explaining the operation of jogging a sheet in conjunction with FIG. 12.

The jogging plate rack 82 includes, as illustrated in FIG. 14, the hole 119 for driving the lower plate 99 of the left side upper guide 76 (FIG. 13), an elongated hole 118 for the jogging plate pin 80 to slidably move in the left side jogging plate guiding groove 71 to move the left side jogging plate 74 (FIG. 12), and a rack groove 84 for the jogging plate pin 80 to slide along a rack guide 85, which is integrated with the jogging table 57 (FIG. 12).

The hole 119 of the jogging plate rack 82 is provided for moving the lower plate 99 of the left side upper guide 76, so that the left side upper guide 76 is in a substantially horizontal position (x position) or in an upwardly slanted position (y position), illustrated FIG. 13. When the jogging plate rack 82 is moved so that the left side upper guide 76 is in the substantially horizontal position (x position) or in the upwardly slanted position (y position), the elongated hole 118 regulates the movement of the jogging plate pin 80 so that the left side upper guide 76 is in the substantially horizontal position (x position) or the upwardly slanted position (y position). When the jogging plate rack 82 moves inwardly in the direction indicated by "In" in FIG. 12, the lower plate 99 is moved by the first movement of the left side jogging plate rack 82, and thereby the left side upper guide 76 is turned into the upwardly slanted position (y position). Thereafter, the elongated hole 118 allows the jogging plate pin 80 to move, so that the left side jogging plate 74 starts to move inwardly.

In FIG. 12, when the left side jogging plate 74 is positioned inside of the jogging table 57, and when the jogging plate rack 82 starts to move outwardly in the direction indicated by "Ou", first the lower plate 99 of the left side upper guide 76 (FIG. 13) is moved so that the left side upper guide 76 is turned into the horizontal position (x position), and thereafter, the left side jogging plate rack 82 moves the jogging plate pin 80, so that the left side jogging plate 74 is moved outwardly in the direction "Ou". A left side position sensor 83 is arranged at a reference position for movement and driving of the left side jogging plate 74 and the right side jogging plate 73.

As illustrated in FIG. 11, a right side jogging plate 73 and a right side upper guide 75, respectively having substantially the same construction as those of the left side jogging plate 74 and the left side upper guide 76, are arranged in symmetrical positions relative to the left side jogging plate 74 and the left side upper guide 76 with respect to the sheet conveying direction. The right side jogging plate 73 and the right side upper guide 75 are symmetrically operated, relative to the left side jogging plate 74 and the left side upper guide 76, respectively, by the right side jogging plate rack 160, which is engaged with the pinion integrated with the pulley 86, which is driven by the motor 88 (see FIG. 12).

An end plate part that jogs the folded sheet 5, which have been discharged toward the jogging table 57, with respect to front and rear sides of the folded sheet 5 in the direction the folded sheet 5 is conveyed, in cooperation with the position determining plate 60 of the binding position determining mechanism 201, includes, as illustrated in FIG. 12, a pulley 92 including a motor 91 fixed to the back side of the jogging table 57, a belt 93, a pinion 94, a rear end jogging plate rack 96, an end plate position sensor 97, an end plate 95, a rear end jogging plate 78, and an end plate axis 79. The end plate part operates substantially in the same manner as the left side jogging plate 74 and the left side upper guide 76, except that the end plate part operates with respect to the forward and backward directions of the folded sheets 5.

Figure 15:
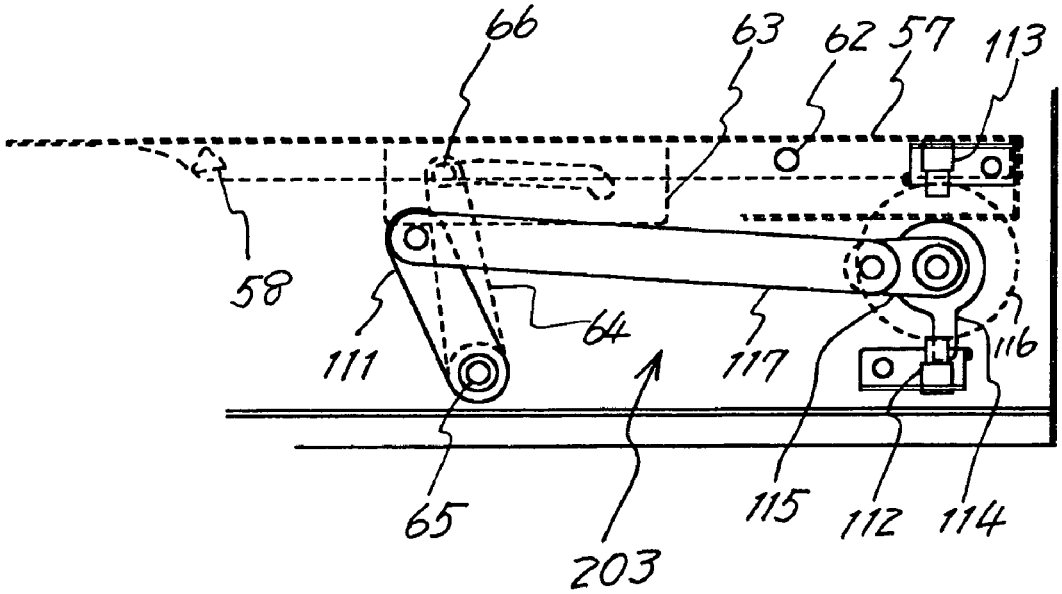
FIG. 15 is a cross section for explaining the operation of the sheet stack discharging part driving mechanism in conjunction with FIG. 10.

Referring to FIG. 15, the jogging table upward/downward moving mechanism 203 includes a supporting axis 62 which mounts the jogging table 57 to the both side plates of the main body so as to swing, and a groove plate 63 which is integrally mounted to each of the side surfaces of the jogging table 57. Further, an arm 64 having a protrusion 66, which is integral with the arm 64 and which engages with a groove hole of the groove plate 63 to move in the groove hole, and an arm 111, which is rotatable relative to the side plate of the main body and which is arranged outside of the arm 64 and the side plate, are fixed to an axis 65.

The jogging table upward/downward moving mechanism 203 further includes an arm 115 and an interrupting plate 114, which are fixed to and which rotate together with an axis fixed to an axis of a motor 116, which is fixed to the side plate of the main body, and a link 117 connecting the arm 115 and the arm 111 with each other.

A sensor 113 and a sensor 112 are arranged so as to oppose each other via the axis of the motor 116. When the interrupting plate 114 rotates together with the axis of the motor 116, the interrupting plate 114 interrupts the sensor 113 and the sensor 112.

When the arm 115, which is integrated with the axis of the motor 116, rotates, the link 117 is reciprocally moved to swing the arm 111. When the arm 111 is in the left side end position (p) in FIG. 15, the interrupting plate 114 interrupts the sensor 112, and when the arm 111 is in the right side end position (q) in FIG. 10, the interrupting plate 114 interrupts the sensor 113.

Referring back to FIG. 11 (see also FIG. 9), the stapling part 16 includes a stapler 121 which is integrated with a rack 123 and an interrupting plate 120, a guide 125 and a guide 126 which guide the stapler 121 to the (u) position and to the (v) position on the stapling table 128, a rack 123 which engages with a pinion 127 fixed to an axis of a motor 122, a rack guide 124 which guides the pinion 127 and the rack 123, and a sensor 140 and a sensor 141 which detect the position of the stapler 121 so as to stop the stapler 121 at the predetermined positions (u) and (v).

The stack discharging part 17 includes, as illustrated in FIG. 10, a gear 130, which is fixed to an axis of a motor 129 fixed to the side plate of the main body, a gear 131, which engages with the gear 130 and which is integrated with an axis 132 of a roller 136, an axis 133 which is rotatably supported by the side plate of the main body, and a roller 138 which is rotatably supported by a discharging plate 137 fixed to the axis 133. An arm 134 integrated with the axis 133 is arranged outside of the side plate. The arm 134 is always pulled by a spring 109 in the counterclockwise direction, so as to be stopped by a stopper 135 at its home position. A spring 110 is attached to the arm 134, at the side opposite the side the spring 109 is attached to, to be connected with a solenoid 102. When a stack of folded sheets 6, which has been stapled, is pushed by the end plate 95 (not shown) toward the stack discharging part 17 by a predetermined distance according to the size of the sheet into between the roller 138 and the roller 136, the solenoid 102 operates so that the roller 138 presses the stapled stack of folded sheets 6 against the roller 136. Thereby, the stapled stack of folded sheets 6 is discharged onto the discharging table 171.

The exit part 18 includes, as illustrated in FIG. 3, an opening part 171 opened toward the rear side of the binding apparatus 3 and an exit table 170.

Now, the operation of the binding apparatus 3 is described.

When the power of the binding apparatus 3 is turned on, each part of the binding apparatus 3 operates so as to be ready for receiving a sheet. As illustrated in FIG. 7, the knife unit 35 is in the (a) position, which is the home position of the knife unit 35, separated from the sheet folding roller pair 42. The sheet center thrusting plate 50 is in the (e) position, so as to be upwardly slanted. The position determining plate 60 is in the (k) position, which is the home position, and the roller 138 is in the (r) position, which is the home position. Further, the jogging table 57 is in the horizontal (m) position, with the interrupting plate 114 interrupting the sensor 112 (FIG. 13) and the arm 64 being in the (p) position.

When a binding instruction including the information on the size of the sheet 4 is received by the controller 19, the sheet stopper 40 of the sheet guiding part 12 is moved to the position corresponding to the size of the sheet 4 according to the information on the size of the sheet 4 so that the sheet 4 is folded at the center portion thereof by the sheet folding part 13. Further, with respect to the left side jogging plate 74 and the right side jogging plate 73 on the jogging table 57, illustrated in FIG. 11, when the motor 88 (FIG. 12) rotates in the clockwise direction to move the left side jogging plate rack 82 and the right side jogging plate rack 160 toward the center of the jogging table 57, first the left side upper guide 76 and the right side upper guide 75 are moved from the horizontal position (x) to the upwardly slanted position (y) (FIG. 13). Thereafter, the jogging plate pin 80, which is integrated with the left side jogging plate 74 and the right side jogging plate 73, is moved, so that the left side jogging plate 74 and the right side jogging plate 73 are moved from the position to interrupt the left side position sensor 83 (FIG. 12 and FIG. 13), toward the center of the jogging table 57, to the position where the folded sheet 5 is conveyed into and jogged, which is determined by the controller 19 according to the information on the size of the sheet 4 being conveyed from the printer 2. The left side jogging plate rack 82 and the right side jogging plate rack 160 (FIG. 12) return an allowance distance L of the elongated hole 118 (FIG. 14), which engages with the jogging plate pin 80 integrated with the left side jogging plate 74 and the right side jogging plate 73. Thereby, the left side upper guide 76 and the right side upper guide 75 in the upwardly slanted positions (y) are turned into the horizontal positions (x), respectively.

Further, referring to FIG. 11, the end plate 95 moves to the position where the folded sheet 5 is jogged, and the rear end thrusting plate 78 is placed in the horizontal position like the left side upper guide 76 and the right side upper guide 75. The stapler 121 is in the (u) position, where the interrupting plate 120 interrupts the sensor 140, to wait the folded sheet 5 to be conveyed thereto.

In FIG. 4, a sheet 4 (not shown) is conveyed from the printer 2 (not shown) into between the side guide pair 32 of the sheet receiving table 31 of the binding apparatus 3. When the sheet sensor 46 detects the sheet 4 being conveyed, the entrance motor 21 (FIG. 5) starts to rotate, so that the entrance roller 33 and the sheet folding roller pair 42 arranged on the entrance roller 33 start to rotate together, so as to convey the sheet 4 into between the lower guide plate 37 and the upper guide plate 36 of the sheet guide part 12.

The sheet 4 is conveyed between the lower guide plate 37 and the upper guide plate 36, and when the sheet leading edge detect sensor 39 detects the leading edge of the sheet 4, the controller 19 adjusts the position of the sheet stopper 40, which has been set according to the size of the sheet 4 as described above, again, according to the detection so that the sheet 4 is folded precisely at the center portion thereof. This adjustment is made because the actual size of the sheet 4 sometime differs from the standard size, for example, by about ±2 mm in an A3 size sheet. Further, the solenoid 47 is operated a predetermined period of time after the detection.

The sheet 4 is stopped by the sheet stopper 40 after the leading edge of the sheet 4 passes the sheet leading edge detect sensor 39. At that time, because the entrance roller 33 and the sheet folding roller pair 42 are rotating, a part of the sheet 4 which is out of the lower guide plate 37 and the upper guide plate 37 is downwardly slackened. Further, the predetermined time after the sheet leading edge detect sensor 39 detects the leading edge of the sheet 4, the solenoid 47 is operated to move the knife unit 35 in the clockwise direction to push the slackened portion of the sheet 4 with the knife 34 of the knife unit 35 toward the sheet folding roller pair 42, so that the slackened pushed portion of the sheet 4 is pinched into between the sheet folding roller pair 42, and thereby the sheet 4 is folded by the sheet folding roller pair 42. The sheet 4 can be folded by the sheet folding roller pair 42 without using a knife unit mechanism, however, the precision of folding the sheet 4 at the center portion of the sheet 4 can be increased by using the knife unit mechanism, and thereby inferior folding of the sheet 4 can be decreased.

The sheet 4, which has been folded into a folded sheet 5, is pressed and is conveyed by the sheet folding roller pair 42 to pass the sheet sensor 44 and to be conveyed into between the supplementary pressing roller pair 45. The folded sheet 5 is further pressed and is conveyed by the supplementary pressing roller pair 45 to be discharged toward the jogging table 57.

Before the folded sheet 5 is discharged toward the discharging table 57, the left side jogging plate 74, the right side jogging plate 73, and the end plate 95 have been placed in the position to jog the folded sheet 5 on the jogging table 57, and the right side upper guide 76, the right side upper guide 75, and the rear end thrusting plate 78 are respectively in the horizontal positions, as described above. The folded sheet 5 discharged toward the jogging table 57 slides over the rear end thrusting plate 78 of the end plate 95, the left side upper guide 76 of the left side jogging plate 74, and the right side upper guide 75 of the right side jogging plate 73, to be stopped by the position determining plate 60.

Referring to FIG. 7, a predetermined period of time after the sheet detect sensor 44 detects the rear edge of the folded sheet 5, the solenoid 55 operates to rotate the arm 54, the axis 53, and the arm 52, which are integrated with each other, around the axis 53 in the clockwise direction, so that the sheet center thrusting plate 50 rotates around the axis 56 to the (f) position so as to thrust the folded sheet 5 substantially to the horizontal position.

Thereafter, referring to FIG. 10, the left side jogging plate 74, the right side jogging plate 73 (not shown), and the end plate 95 are moved to the positions to interrupt the left side position sensor 83 and the end plate position sensor 97, respectively. This position is where the left side upper guide 76, the right side upper guide 75, and the rear edge thrusting plate 78 separate from the folded sheet 5 carried thereupon, so that the folded sheet 5 is fallen onto the jogging table 57. When the left side jogging plate 74, the right side jogging plate 73, and the end plate 95 are moved to the above-described positions, the left side upper guide 76, the right side upper guide 75, and the rear edge thrusting plate 78 are kept in the horizontal positions, respectively.

Immediately after the left side position sensor 83 and the end plate position sensor 97 have been interrupted, the motor 88 and the motor 91 start to rotate in the reverse direction, so that the left side jogging plate 74, the right side jogging plate 73 (not shown in FIG. 12), and the end plate 95 return to the jogging position for the folded sheet 5. At this time, first, the left side upper guide 76, the right side upper guide 75 (not shown in FIG. 10), and the rear end thrusting plate 7 are turned into the upwardly slanted positions, respectively.

After the left side jogging plate 74, the right side jogging plate 73, and the end plate 95 return to the jogging position for the folded sheet 5, the motor 88 and the motor 91 rotate in the reverse direction for the allowance distance L (FIG. 14) of the elongated hole 118 relative to the jogging pin 80 for the left side jogging plate rack 82, the right side jogging plate rack 160, and the rear edge jogging plate rack 96, so as to move the left side jogging plate rack 82, the right side jogging plate rack 160, and the rear end jogging plate rack 96. Thereby, without moving the left side jogging plate 74, the right side jogging plate 73, and the end plate 95, the left side upper guide 76, the right side upper guide 75, and the rear edge thrusting plate 78 are put into the horizontal positions, respectively, and stopped in the positions.

After the left side jogging plate 74, the right side jogging plate 73, and the end plate 95 moves to the jogging position for the folded sheet 5 so as to jog the folded sheet 5 to the position and the left side upper guide 75, the right side upper guide 76, and the rear edge thrusting plate 78 move to the horizontal positions (x) to be stopped in the positions, the solenoid 55 is released so that the sheet center thrusting plate 50 returns to the upwardly slanted position (e) (FIG. 7).

The binding apparatus 3 then receives a subsequent sheet 4, and the sheet 4 is folded at the center portion thereof, to be a folded sheet 5. The folded sheet 5 is then conveyed by the supplementary pressing roller pair 45, so as to be discharged toward the previously conveyed folded sheet 5 on the jogging plate 57.

The sheet sensor 44 detects the rear edge of the discharged folded sheet 5, and after a predetermined period of time, the sheet center thrusting plate 50 rotates to the horizontal position (f) (Fi. 7) so as to thrust the folded sheet 5 carried on the left side upper guide 75, the right side upper guide 76, and the rear edge thrusting plate 78, and thereafter the left side jogging plate 74, the right side jogging plate 73, and the end plate 75 start to move toward outside in FIG. 11. After the left side jogging plate 74, the right side jogging plate 73, and the end plate 95 move to the positions to interrupt the left side position sensor 83 and the end plate position sensor 97 (FIG. 12), where the left side upper guide 76, the right side upper guide 75, and the rear edge thrusting plate 78 separates from the folded sheet 5 carried thereupon, the left side upper guide 76, the right side upper guide 75, and the rear edge thrusting plate 78 are put into the upwardly directed positions (y), and then the left side jogging plate 74, the right side jogging plate 73, and the end plate 95 return to the jogging positions for the folded sheet 5, where the left side upper guide 76, the right side upper guide 75 and the rear edge thrusting plate 78 return to the horizontal positions (x), respectively, so as to thrust the subsequently conveyed folded sheet 5.

Thus, the sheet center thrusting plate 50 thrusts each of the folded sheets 5, received one by one on the jogging table 47, from above, and the left side jogging plate 74, the right side jogging plate 73, and the end plate 95 jog the folded sheets 5, respectively. Further, the left side upper guide 76, the right side upper guide 75, and the rear edge thrusting plate 78 suppress bulges of the folded sheets 5. Furthermore, the sheet center thrusting plate 50 upwardly rotates, so that the upper surfaces of the left side upper guide 76, the right side upper guide 75 and the rear edge thrusting plate 78 function as the guides for the folded sheet 5 which is subsequently conveyed thereto.

After a last sheet 4 of a predetermined number of sheets 4 according to the binding instruction is folded into a last folded sheet 5 and the last folded sheet 5 is stacked on the jogging table 57, the sheet center thrusting plate 50 thrusts the last folded sheet 5 from above, and the left side jogging plate 74, the right side jogging plate 73, and the end plate 95 jog the last folded sheet 5 to the jogging position, with the left side upper guide 76, the right side upper guide 75, and the rear edge thrusting plate 78 kept in the horizontal positions (x) so as to hold a stack of folded sheets 6, the stapler 121 staples the stack of folded sheets 6 in the (u) position of FIG. 11. Thereafter, the motor 122 rotates in the clockwise direction to move the rack 123 to thereby move the stapler 121 from the (u) position toward the (v) position. The stapler 12 staples again in the (v) position, where the interrupting plate 120 of the stapler 121 interrupts the sensor 141 and the motor 122 stops. The stapler 121 then returns to the (u) position.

When the stapling is completed at the (v) position, the sheet center thrusting plate 50 returns to the (e) position, and the end plate 95 on the jogging table 57 starts to move toward outside, to be stopped after moving a predetermined distance. At the same time, the solenoid 101 is turned on, so that the position determining plate 60 moves from the (k) position to the (l) position (FIG. 7). Thereby, the stapled stack of sheets 6 is thrust to be discharged to the opening of the stapler 121.

In FIG. 10, the motor 116 rotates in the clockwise direction, so that the interrupting plate 114 rotates to interrupt the sensor 113 and the jogging table 57 rotates from the (m) position to the (n) position (FIG. 7) around the supporting axis 62. The motor 129 rotates to rotate the roller 136, and at the same time the end plate 95 on the jogging table 57 (FIG. 11) moves toward the center of the base plate 57. Thereby, the stack of folded sheets 6 is pushed toward the stack discharging part. When the stack of folded sheets 6 has been pushed toward the stack discharging part 17 the predetermined distance, which has been determined by the controller 19 according to the size of the sheet 4, the solenoid 102 operates so that the roller 138 presses the stack of folded sheets 6 against the roller 136, and the stack of folded sheets 6 is discharged onto the discharging table 171 with the roller 138 and the roller 136.

The sensor 58 detects that stack of folded sheets 6 is discharged from the jogging table 57, so that the stapling operation is completed. The binding apparatus 3 then prepares for receiving a next sheet 4 conveyed from the printer 4.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application No. 2000-213730 filed in the Japanese Patent Office

What is claimed as new and is desired to be secured by Letter Patent of the United State is:

1. A method of binding sheets, comprising:

receiving a sheet from outside and conveying the sheet;

receiving information on a size of the sheet;

receiving and guiding the conveyed sheet;

folding the conveyed sheet in two at a center portion thereof in a direction the sheet is conveyed so as to be a folded sheet and conveying the folded sheet with the folded portion of the folded sheet being a leading edge of the folded sheet with a sheet folding device, wherein a position where the conveyed sheet is stopped is set according to the size of the sheet so that the sheet is folded by the sheet folding device at the center portion of the sheet, and wherein the sheet to be conveyed is stopped at the position, so that the center portion of the sheet is downwardly slackened, the slackened center portion of the sheet is pinched into the sheet folding device, and thereby the sheet is folded in two at the center portion of the sheet by the sheet folding device, and wherein a leading edge of the sheet is detected, and the slackened center portion of the sheet is pushed toward the sheet folding device with a pushing device at a predetermined timing after the detection of the leading edge of the sheet, so that the slackened center portion of the sheet is pinched into the sheet folding device;

receiving and jogging the conveyed folded sheet one after another so as to be stacked into a stack of folded sheets with a receiving/jogging device;

binding the stack of stacked folded sheets at an edge portion of the stack of folded sheets at the side where the folded portion of each folded sheet of the stack of folded sheets is located with a binding device; and discharging the bound stack of folded sheets.

2. The binding method of claim 1, the pushing device including a saw-toothed knife to push the slackened center portion of the sheet, and wherein, the pushing includes perforating the sheet at the pushed center portion of the sheet with the saw-toothed knife.

3. The binding method of claim 1, wherein the sheet folding device includes a pair of sheet folding rollers and a pair of supplementary pressing rollers, wherein the pair of supplementary pressing rollers is arranged downstream of the pair of sheet folding rollers in the direction the folded sheet is conveyed and is angled relative to the pair of sheet folding rollers, and a distance between a nip portion of the pair of supplementary rollers and a nip portion of the pair of the sheet folding rollers at a position corresponding to a widthwise edge of the folded sheet, at a side of a widthwise direction where the pair of the supplementary rollers and the pair of sheet folding rollers are farther separated from each other, is shorter than a length of the folded sheet in the direction the folded sheet is conveyed, and wherein the folding/pressing includes folding the sheet with the pair of sheet folding rollers and pressing the folded sheet with the pair of supplementary pressing rollers.

4. A method of binding sheets, comprising:

receiving a sheet from outside and conveying the sheet;

receiving information on a size of the sheet;

folding the conveyed sheet in two at a center portion thereof in a direction the sheet is conveyed so as to be a folded sheet and conveying the folded sheet with the folded portion of the folded sheet being a leading edge of the folded sheet with a sheet folding device;

determining a size of the folded sheet folded at the center of the sheet;

receiving and jogging the conveyed folded sheet one after another so as to be stacked into a stack of folded sheets with a receiving/jogging device, the receiving/jogging device including a leading edge stopping device to stop the folded sheet, an upper guide member to guide the folded sheet conveyed by the sheet folding device and a jogging member to jog the folded sheet, wherein the receiving and jogging of the conveyed folded sheet comprises, sliding the conveyed folded sheet over an upper surface of the upper guide member of the jogging device, which is in a substantially horizontal position, to be stopped by the leading edge stopping device and to be carried on the upper surface of the upper guide member, moving the jogging device to a first position where the folded sheet carried on the upper surface of the upper guide member separates from the upper guide member to fall onto the jogging table, swinging the upper guide member from the horizontal position to a slanted position where the upper guide member is upwardly slanted, and moving the jogging device to a second position where the jogging member of the jogging device is in a position corresponding to the size of the folded sheet being received;

binding the stack of stacked folded sheets at an edge portion of the stack of folded sheets at the side where the folded portion of each folded sheet of the stack of folded sheets is located with a binding device; and discharging the bound stack of folded sheets.

5. The binding method of claim 4, wherein the folding device further includes a detect device to detect that the folded sheet is discharged toward the jogging device and a sheet center thrusting device to downwardly thrust the folded sheet carried on the upper surface of the upper guide member of the jogging device, and wherein the receiving/jogging further includes;

detecting that the folded sheet is discharged toward the jogging device with the detect device, and swinging the sheet center thrusting device between a substantially horizontal position where the sheet center thrusting device downwardly thrusts the folded sheet carried on the upper surface of the upper guide member of the jogging device and a slanted position where the sheet center thrusting device is upwardly slanted.

6. The binding method of claim 5, wherein in the binding, the jogging member of the jogging device is in the second position, the upper guide member is in the horizontal position, and the sheet center thrusting device is in the horizontal position.

7. The binding method of claim 4, the receiving/jogging including;

stopping the folded sheet to be conveyed at a leading edge of the folded sheet so that the folded sheet is jogged relative to the binding device, and adjusting a position to stop the folded sheet so that that a position in the folded sheet relative to the leading edge thereof where the binding device binds the stack of folded sheet is changed.

8. A method of folding and jogging sheets, comprising:

receiving a sheet from outside and conveying the sheet;

receiving information on a size of the sheet;

folding the conveyed sheet in two at a center portion thereof in a direction the sheet is conveyed so as to be a folded sheet and conveying the folded sheet with the folded portion of the folded sheet being a leading edge of the folded sheet with a sheet folding device, wherein folding the conveyed sheet and conveying the folded sheet comprises receiving and guiding the sheet, setting a position where the conveyed sheet is stopped to be conveyed according to the size of the sheet so that the sheet is folded by the sheet folding device at the center portion of the sheet, and stopping the sheet to be conveyed at the position, so that the center portion of the sheet is downwardly slackened, the slackened center portion of the sheet is pinched into the sheet folding device, and thereby the sheet is folded in two at the center portion of the sheet by the sheet folding device, and wherein folding the conveyed sheet and conveying the folded sheet further comprises detecting a leading edge of the sheet, and pushing the slackened center portion of the sheet to the sheet folding device with a pushing device at a predetermined timing after the detection of the leading edge of the sheet, so that the slackened centered portion of the sheet is pinched into the sheet folding device; and receiving and jogging the conveyed folded sheet one after another so as to be stacked into a stack of folded sheets with a receiving/jogging device.

9. The folding/jogging method of claim 8, the pushing device including a saw-toothed knife to push the slackened center portion of the sheet, and wherein, the pushing includes perforating the sheet at the pushed center portion of the sheet.

10. The folding/jogging method of claim 8, wherein the sheet folding device includes a pair of sheet folding rollers and a pair of supplementary pressing rollers, wherein the pair of supplementary pressing rollers is arranged downstream of the pair of sheet folding rollers in the direction the folded sheet is conveyed and is angled relative to the pair of sheet folding rollers, and a distance between a nip portion of the pair of supplementary rollers and a nip portion of the pair of the sheet folding rollers at a position corresponding to a widthwise edge of the folded sheet, at a side of a widthwise direction where the pair of the supplementary rollers and the pair of sheet folding rollers are farther separated from each other, is shorter than a length of the folded sheet in the direction the folded sheet is conveyed, and wherein the folding/pressing includes folding the sheet with the pair of sheet folding rollers and pressing the folded sheet with the pair of supplementary pressing rollers.

11. A method of folding and jogging sheets, comprising:

receiving a sheet from outside and conveying the sheet;

receiving information on a size of the sheet;

folding the conveyed sheet in two at a center portion thereof in a direction the sheet is conveyed so as to be a folded sheet and conveying the folded sheet with the folded portion of the folded sheet being a leading edge of the folded sheet with a sheet folding device;

determining a size of the folded sheet folded at the center of sheet; and receiving and jogging the conveyed folded sheet one after another so as to be stacked into a stack of folded sheets with a receiving/jogging device, wherein the receiving/jogging device includes a leading edge stopping device to stop the folded sheet, an upper guide member to guide the folded sheet conveyed by the sheet folding device and a jogging member to jog the folded sheet, wherein receiving and jogging the conveyed folded sheet further comprises sliding the conveyed folded sheet over an upper surface of the upper guiding member of the jogging device, which is in a substantially horizontal position, to be stopped by the leading edge stopping device and to be carried on the upper surface of the upper guide member, swinging the upper guide member from the horizontal position to a slanted position where the upper guide member is upwardly slanted and moving the jogging member to a second position where the jogging member is in a position corresponding to the size of the folded sheet being received.

12. The folding/jogging method of claim 11, wherein the folding device further includes a detect device to detect that the folded sheet is discharged toward the jogging device and a sheet center thrusting device to downwardly thrust the folded sheet carried on the upper surface of the upper guide member of the jogging device, and wherein the receiving/jogging further includes;

detecting that the folded sheet is discharged toward the jogging device with the detect device, and swinging the sheet center thrusting device between a substantially horizontal position where the sheet center thrusting device downwardly thrusts the folded sheet carried on the upper surface of the upper guide member of the jogging device and a slanted second position where the sheet center thrusting device is upwardly slanted.

13. The folding/jogging method of claim 12, wherein in the binding, the jogging member of the jogging device is in the second position, the upper guide member is in the horizontal position, and the sheet center thrusting device is in the horizontal position.

* * * * *